US006464099B1

(12) United States Patent
Portman et al.

(10) Patent No.: US 6,464,099 B1
(45) **Date of Patent: *Oct. 15, 2002**

(54) RAISED CONTAINER LID FOR BEVERAGE BAG RETENTION AND RELATED PREPARATION METHODS

(75) Inventors: Jill Portman; Gary Shinner, both of Sausalito; Michael Barry, Palo Alto, all of CA (US)

(73) Assignee: Mighty Leaf Tea, Sausalito, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/721,247

(22) Filed: Nov. 22, 2000

Related U.S. Application Data

(63) Continuation-in-part of application No. 09/525,888, filed on Mar. 15, 2000, which is a continuation-in-part of application No. 09/231,180, filed on Jan. 14, 1999, now abandoned, which is a continuation-in-part of application No. 08/831,806, filed on Apr. 9, 1997, now abandoned, which is a continuation-in-part of application No. 08/529,061, filed on Sep. 15, 1995, now Pat. No. 5,657,898.

(51) Int. Cl.[7] ..... A47G 19/22

(52) U.S. Cl. ..... 220/712; 220/717; 220/711; 215/387; 229/404; 426/77; 426/80; 426/83

(58) Field of Search ..... 220/711–713, 716–718, 220/254, 703, 780; 215/387; 99/319, 321, 322, 289; 426/80, 83, 77, 435; 229/404, 906.1

(56) References Cited

U.S. PATENT DOCUMENTS

| | | | | |
|---|---|---|---|---|
| 1,123,467 A | | 1/1915 | Bauer | 99/319 |
| 1,785,878 A | | 12/1930 | Schachter | 99/319 |
| 2,214,437 A | | 9/1940 | Punte | 206/42 |
| 2,534,614 A | * | 12/1950 | Michael | 220/713 |
| 2,728,671 A | | 12/1955 | Young et al. | 99/77.1 |
| 2,728,672 A | | 12/1955 | Young et al. | 99/77.1 |
| 2,800,408 A | | 7/1957 | Fimple | 99/77.1 |
| 2,878,927 A | | 3/1959 | Haley | 206/5 |
| 2,918,373 A | * | 12/1959 | Weston | |
| 3,090,542 A | | 5/1963 | Miller | 229/51 |
| 3,246,786 A | | 4/1966 | Holley | 215/100.5 |
| 3,459,324 A | | 8/1969 | Miller | 220/44 |
| 3,524,566 A | | 8/1970 | Parks | 220/27 |

(List continued on next page.)

FOREIGN PATENT DOCUMENTS

| | | | |
|---|---|---|---|
| JP | 10-35663 | * | 2/1998 |
| US | 09/07047 | | 10/1998 |

*Primary Examiner*—Lee Young
*Assistant Examiner*—Robin A Hylton
(74) *Attorney, Agent, or Firm*—Baniak Pine & Gannon

(57) ABSTRACT

Apparatus and methods for the individual controlled preparation of a beverage from one or more beverage bags within a variety of containers and the quick and sanitary storage of the bag or bags once the beverage preparation has been completed. Preferably, the beverage preparation and bag storage apparatus is sized and shaped to be seated on the lip of a container to cover the mouth of the container. The apparatus includes a raised container lid bag retention structure that is openable or open such that at least a portion of the beverage bag may be drawn within and thereby retained in a position elevated above the beverage so that the beverage can be sampled and consumed even with the apparatus in place on the container and the bag or bags retained within the apparatus. One embodiment of such apparatus includes a rounded raised area having a patterned area, such as weakenings formed in or perforations or incisions cut through the flexible cover panel, that can be opened partially or completely to provide a string/tag securing aperture or completely to provide a bag retention aperture by the application of respectively increasing amounts of pressure at the patterned area.

15 Claims, 14 Drawing Sheets

U.S. PATENT DOCUMENTS 3,797,642 A 3/1974 Dobry et al. ..... 206/0.5
3,822,030 A * 7/1974 Tanzer
3,861,284 A * 1/1975 Costello
3,915,296 A * 10/1975 Spencer
3,952,910 A 4/1976 Wheeler ..... 220/90.4
4,074,827 A * 2/1978 Labe, III
4,141,462 A 2/1979 Rucci ..... 220/254
4,184,603 A * 1/1980 Hamilton, Sr.
4,210,272 A * 7/1980 Sequin ..... 229/906.1 X
4,250,990 A * 2/1981 Casper
4,333,583 A 6/1982 Montemarano ..... 220/90.4
4,428,498 A * 1/1984 Obey
4,441,624 A 4/1984 Sokolowski ..... 220/254
4,503,992 A 3/1985 Sitko et al. ..... 220/90.4
D282,615 S 2/1986 Levine ..... D7/9
4,574,970 A * 3/1986 Schwarz ..... 220/713
4,589,569 A * 5/1986 Clements ..... 229/906.1 X
4,629,088 A 12/1986 Durgin ..... 220/254
D287,919 S * 1/1987 Clements
4,880,110 A 11/1989 Walker ..... 206/0.5
5,129,524 A 7/1992 Holman ..... 211/113
5,183,172 A 2/1993 Boller ..... 220/270
5,197,624 A 3/1993 Dodaro ..... 220/254
5,253,781 A * 10/1993 Van Melle et al.
5,398,843 A * 3/1995 Warden et al. ..... 220/703 X
5,409,131 A 4/1995 Phillips et al. ..... 220/717
5,620,724 A * 4/1997 Adler
5,624,053 A 4/1997 Freek et al. ..... 220/713
5,657,898 A * 8/1997 Portman et al. ..... 220/713 X
5,692,616 A 12/1997 Baker ..... 220/713
5,775,205 A * 7/1998 Melton
D402,556 S * 12/1998 Frye
5,890,619 A * 4/1999 Belanger ..... 220/713
5,911,331 A * 6/1999 Boller
5,924,354 A 7/1999 Court et al. ..... 99/318
5,947,321 A 9/1999 Vadney ..... 220/367.1
D417,845 S * 12/1999 Sadlier et al.
5,996,837 A * 12/1999 Freek et al. ..... 220/713
6,047,852 A * 4/2000 Evans et al. ..... 220/713 X
D437,223 S * 2/2001 Coy et al.

* cited by examiner 221
22
21
24A
31
70
91
45
61
62
17
9C
9C
15
20

21
22A
22
26
91
71
17
61
15
20
11
12

20
17
21
22
23
71
14B
15
12B
19A
19
12A

FIG. 10A
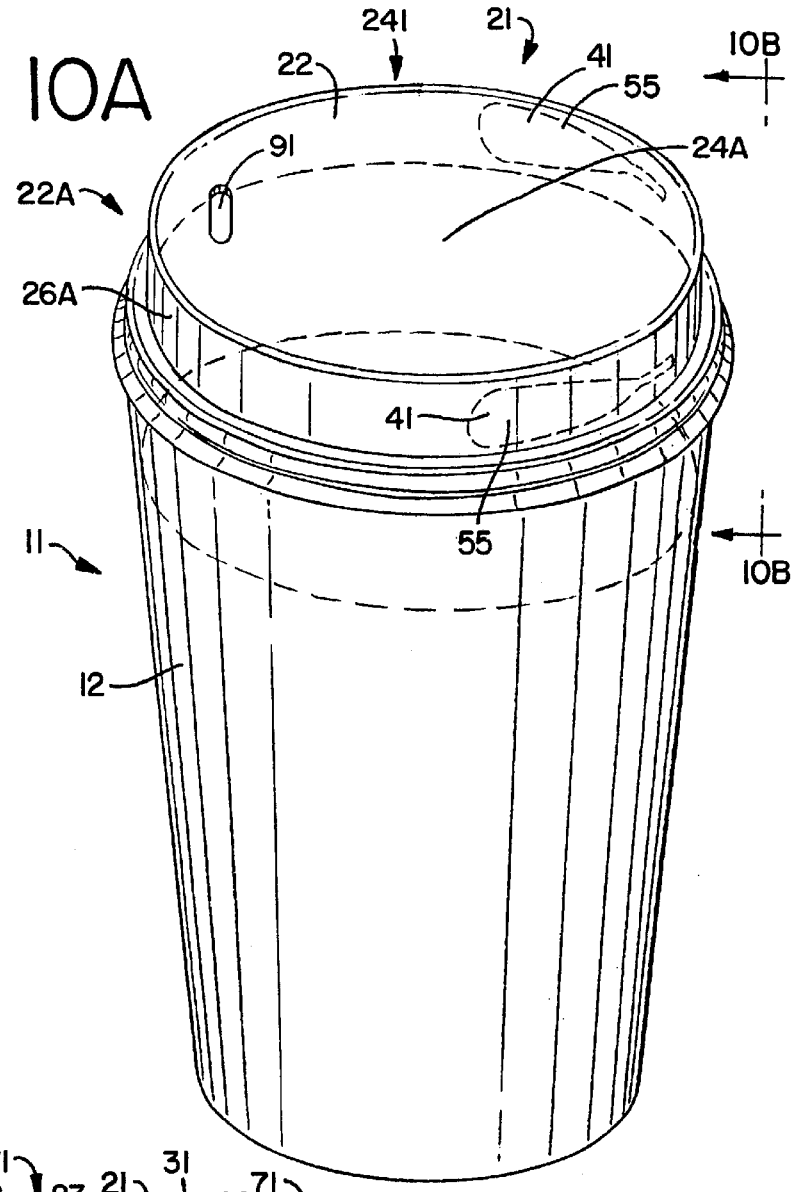
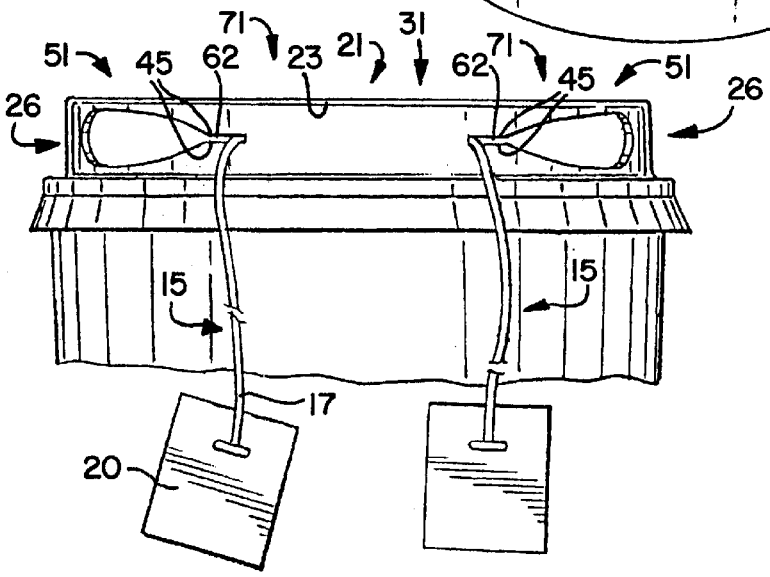
FIG. 10B

FIG. 12A
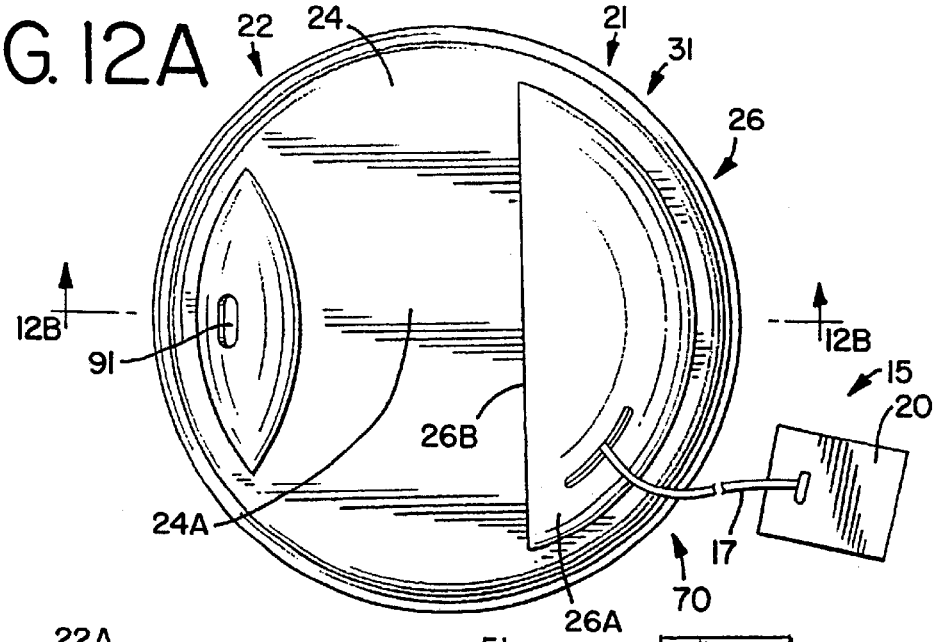
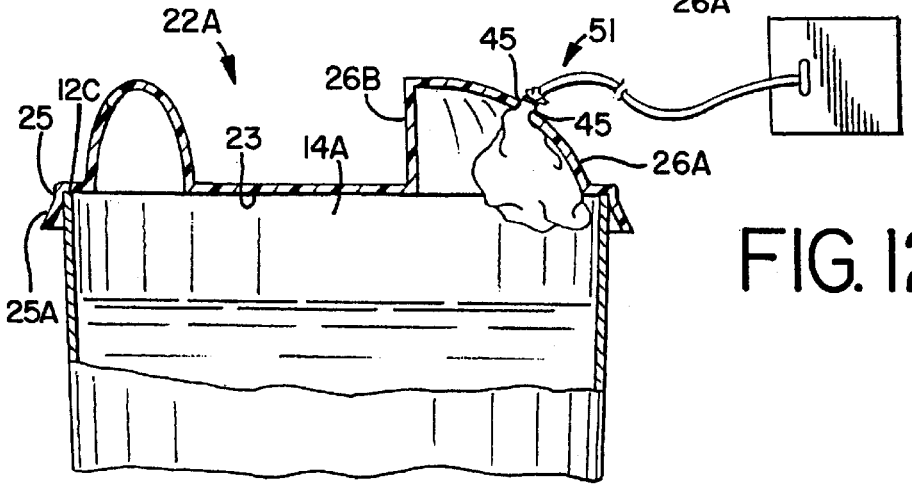
FIG. 12B
FIG. 12C
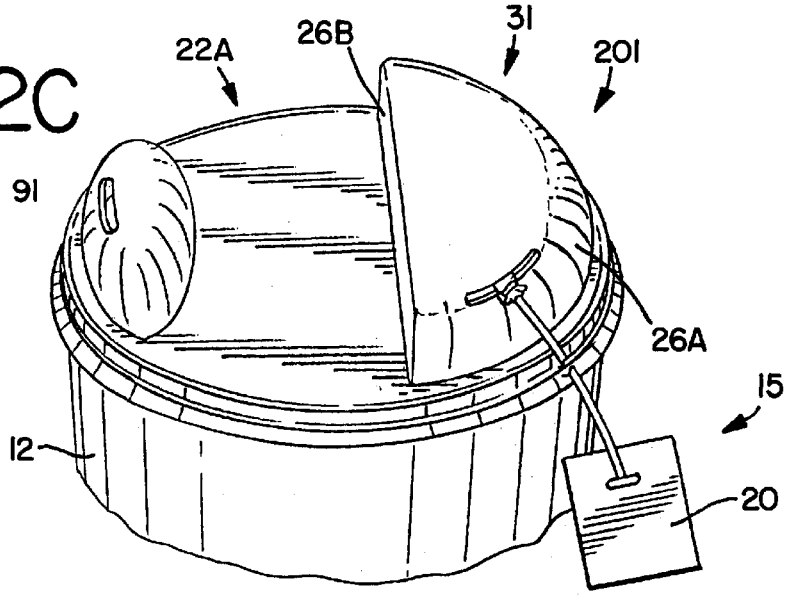

RAISED CONTAINER LID FOR BEVERAGE BAG RETENTION AND RELATED PREPARATION METHODS

CROSS REFERENCE TO RELATED APPLICATIONS

This application is a continuation in part of U.S. application Ser. No. 09/525,888 filed on Mar. 15, 2000 which is a continuation in part of the U.S. application Ser. No. 09/231,180 filed on Jan. 14, 1999, which was co-pending as of the filing date of this latter application. U.S. application Ser. No. 09/231,180 was a continuation in part of the U.S. application Ser. No. 08/831,806 filed on Apr. 9, 1997, which was co-pending as of the filing date of that previous application. U.S. application Ser. No. 08/831,806 was a continuation in part of the U.S. application Ser. No. 08/529,061 filed on Sep. 15, 1995, which was co-pending as of the filing date of that previous application, and for which U.S. Pat. No. 5,657,898 was granted on Aug. 19, 1997.

FIELD OF THE INVENTION

The subject invention relates to apparatus and methods by which beverages may be prepared and consumed quickly and sanitarily. More particularly, the invention relates to container lids and methods that facilitates the individual controlled preparation of a beverage from one or more beverage bags within a variety of containers and the quick and sanitary storage of the bag or bags once the beverage preparation has been completed.

BACKGROUND OF THE INVENTION

Many liquid beverages are prepared by immersing a porous bag containing tea or coffee or other beverage preparation agent in a liquid for a given period of time. The immersion of the bag allows soluble components from the beverage preparation agent to go into solution thereby producing the beverage. This process is termed also steeping or brewing by infusion. The terms immersion, steeping, and brewing will be used largely interchangeably in the following to identify the step in the process and period when the bag is partially or wholly within the beverage preparation liquid. The beverage preparation agent will be identified in the following also as "bag contents" or simply "contents". During the immersion process, and if the bag contents are a "non-instant" version of a dry or dried substance, such as ground coffee or leaf or shredded tea, the contents take up the liquid, thereby swelling in size and increasing in weight. Generally, the longer the bag remains in the solution, the stronger the beverage becomes. However, particularly with regard to tea, it is generally imperative that the bag not be allowed to remain in the liquid too long since the tea may become overly strong or bitter components from the tea may become solubilized. Preparing a beverage from a beverage bag provides the consumer with greater control over the steeping process since it can be stopped by removing the beverage bag from the liquid.

Beverage bags can be conventionally formed in a number of ways such as by the joining of two sheets of porous material at their edges such that the bag has opposing side walls and opposing edges or simply by gathering and/or joining a single sheet into a pouch-like shape having a generally continuous surrounding wall. The porous bag must provide a large inner volume to accommodate contents that increase in size and weight during immersion and have a structure so that the bag can freely be moved within and removed from the beverage without tearing. Conventionally, a string is attached adjacent to one edge of the bag to allow the consumer to immerse a bag within the liquid and remove it without having to come into contact with the bag or the immersion liquid. A finger tip-sized tag may be attached adjacent to the string at a place generally opposite to the place at which the string is attached to the bag to facilitate the removal of the bag by the string. In this application, the terms "beverage bag" or "bag" will mean to identify any such porous bag that is sized and shaped and structured such that it can: contain a beverage preparation agent—whether tea, coffee, or other flavoring or beverage preparation material—; be immersed in a liquid to produce a beverage; and, be drawn up from the beverage such as by a string that may also contain a tag. Because more than one bag can be used in certain embodiments of the present invention, the term "bag" in the following can mean also a plurality of bags in the following.

Some of the many apparatus and systems that are directed to facilitate the preparation of beverages from such bags will be discussed.

U.S. Pat. No. 2,728,671 and U.S. Pat. No. 2,728,672 each describe a combination cover and beverage infusion commodity container in which the container is secured to a lower side of the cover so that the container is suspended from the cover. The combination apparatus is structured so that the cover may rest on the lip of a beverage making vessel and the commodity container is partially immersed in the liquid within the vessel to produce a beverage. Once the beverage has been produced, the steeping/infusion process cannot be stopped with the apparatus in place on the lip of the vessel. Also, the beverage cannot be consumed with the combination cover/container in place. To stop the steeping/infusion process and/or in order to consume the beverage, the entire combination cover/container must be raised from the lip of the beverage making vessel. To remove excess liquid from the dripping commodity container, the cover is folded over at a median fold line and the commodity container is squeezed between the divided portions of the cover. If the combination cover/container is placed back onto the beverage vessel—such as to keep a hot beverage from cooling down—the commodity container may become immersed in the beverage again thereby reinitiating the infusion process and preventing the beverage from being consumed until the apparatus is again separated from the lip of the vessel. After the cover to which is attached the wet commodity container is separated from the beverage vessel, the consumer must hold onto it or find a separate place on which it can rest or in which it can be properly discarded.

Similarly, U.S. Pat. No. 2,800,408 describes an apparatus for preparing beverage in a cup from a tea bag, the apparatus comprising a thin cover formed from a sheet of material folded to provide two hinged sections and to which the tea bag is permanently secured. The cover includes an opening in the center of the sheet that is of a size and shape such that a string from the tea bag may be extended through it. The tea bag string is attached by a staple to the outside of the cover. The cover includes an inclined passage that leads from the edge of the cover to the central opening. In order to stop the steeping process and begin consumption of the beverage, the consumer must remove the cover/tea bag assembly. Dripping from the tea bag is prevented by the application of manual pressure on the outer surface of the two sections of the assembly so that the tea bag is squeezed therein between. The cover/tea bag assembly must be positioned on another receptacle or discarded altogether.

U.S. Pat. No. 2,878,927 is directed to a cord harness assembly including a supporting card and a suspension cord fastened to the tea or coffee bag. The supporting card is not sized and shaped to function as a lid but is shown and described as being of a size slightly larger than the periphery of a rolled-up compressed bag. Through the looping of the cord and drawing of the cord upward with one hand, while the supporting card is held by the other hand, the bag can be raised from the liquid and squeezed against the under surface of the card. Once in the undersurface squeezed position, the consumer must find a place to accommodate the cord harness assembly with wet bag in order to have free use of both hands.

U.S. Pat. No. 2,918,373 is directed to a tea brewing device described as including a disc member adapted such that the device may be placed on the rim of a tea cup. The disc member comprises a peripheral portion having a downwardly concave annular flange adapted such that the device may be placed on the tea cup rim and a circular inner portion that is depressed relative to the peripheral portion. The circular inner portion is formed with a pair of opposing substantially rectangular resilient fingers being of substantial width and closely adjacent straight free end edges that are spaced apart symmetrically on opposite sides of and parallel to the diameter of the disc member. The fingers may be formed by parallel slits spaced apart from each other so that a conventional tea bag may be received and gripped between the opposing edges of the slits. In use, a tea bag is gripped between the edges such that one portion of the tea bag is exposed above the disc and another portion is suspended below the disc. The disc is placed on the tea cup so that the suspended portion of the bag is within the hot water. After the infusion has been completed, the consumer may grasp the portion of the tea bag that is exposed above the upper surface of the disc—that upper bag portion presumably having drawn up some of the liquid from the container and therefore being wet—and draw up the remaining suspended portion of the tea bag through the spaced apart edges. This device does not provide the means by which a consumer may sample the liquid or consume the beverage without removing the device and therefore stopping the infusion process. The device does not provide the means by which the removed tea bag can be sanitarily stored or positioned adjacent to the container or without having to find an additional place to discard it. Furthermore, because this tea brewing device allows only a portion of the tea bag to be suspended below the disc, tea can be brewed only in those containers in which the level of the liquid is generally close to the rim. Attempting to brew tea in such a container may be dangerous since some cups—particularly those disposable cups having the typical small base and outwardly flaring surrounding wall—may become top heavy and prone to tip over when filled to such a level. Also, liquid at such a level may more easily splash out from openings in the cover and injure the consumer and/or require clean-up. As a result, such a cup would not likely be used by those on the go and not, for example, without the container and device positioned on a stable surface.

U.S. Pat. No. 3,797,642 describes a suspending member that at least partly engages a rim of a vessel and that maintains a tea bag in a substantially horizontal position at about or near the top of the vessel so that the beverage is brewed without dunking or squeezing the tea bag. The suspending member is not described as being adjustable to permit tea to be brewed in cups that are filled with liquid at different levels. Because the suspending member permits tea to be brewed only when the cup is sufficiently filled with liquid so as to cover the horizontally aligned tea bag, the cup filled as necessary with suspending member and tea bag in place may be top heavy and therefore prone to tipping over. The suspending member is not described as providing the means by which the liquid may be sampled or the completely brewed beverage enjoyed with the member in place.

U.S. Pat. No. 3,861,284 describes a cup lid for brewing tea and the like including a base flange and a diametrical narrow flange extending vertically upward from the flange. One embodiment of the flange is open at both ends and described as having dimensions greater than a tea bag and into which a wet tea bag may be drawn. In use, the bag is lowered from the flange into the water within the cup and when steeping has been completed, the bag is drawn back up into funnel, The operator is instructed to use his or her fingers to depress the flat sides of the funnel in order to squeeze excess tea from the bag. As the cup lid does not provide the means by which the beverage may be consumed with the lid in place on the container, the lid together with the bag must be removed and discarded. A container on which the cup lid is fitted and with a wet tea bag drawn up into the flange may be top heavy and prone to tip over and therefore dangerous.

U.S. Pat. No. 4,880,110 describes a tag-like grasping means located at the end of retrieval means for infusion bags that include a shaped slit for forming an adjustable hook-like portion such that the grasping means may be clipped to the rim of a container. No means are provided for the storage of the infusion bag adjacent to the level of the beverage after the bag is removed.

Many other apparatus and systems are directed to facilitate the consumption, but not necessarily the preparation of beverages. For example, a wide variety of lids are known that are sized and shaped to be fitted on and around the edge of a container in which a beverage is stored and through which a beverage can be consumed. Generally, such beverage consumption lids are intended to prevent contaminants—such as dust, hair, dirt, or other matter—from entering the containerized beverage. Such lids also may prevent the liquid from splashing out from the container—such as when the container is carried—or from spilling out from the container—such as when the container is tipped over. Lids also may moderate the change in temperature of the containerized liquid, such as to slow the cooling of a hot liquid or the heating of a cold liquid.

More specifically, cup lids may include openings that allow the beverages to be consumed without removal of the lid. Some such cup lids openings are constructed to allow the consumer to drink from the container by direct contact of the consumer's lips with the surface of the cup lid around a "drink through aperture". These "drink through apertures" include those that are raised relative to other portions of the lid upper surface, those having areas that are inverted to expose the drink aperture, those having areas covered by tear away strips or movable flaps, and those associated with complicated flexible drinking spouts extending from the lid. Other lids do not provide such drink through apertures. Other lids compliment such drink though apertures with or provide only an area aperture in which a separate apparatus may be inserted to allow a consumer to drink through the lid. Some of such insertion areas are sized and shaped to allow a suitably stiff or reinforced straw to be inserted through the area. Conventionally, the straw insertion areas are formed by placing two equally sized and symmetrically crossing incisions through the lid. By forcing the tip of the suitably stiff/reinforced straw against and through the incised area, an opening is formed that is no larger than and generally shaped to correspond to the size and shape of the outer diameter of the straw. Such a limited size and shape of the straw insertion area is considered advantageous in that little, if any fluid can splash or spill out from the area between the straw and the lid and gases below the lid cannot be exchanged with the outside environment thereby slowing the change in the temperature of the fluid. Because of the conventional resultant tight fit between straw and the straw insertion aperture, lids providing such an aperture must provide also a separate vent hole located elsewhere on the lid in order to prevent a vacuum from forming under the lid when the consumer attempts to draws liquid up through the straw. Such vent holes are conventionally taught as being pin hole size so that again little liquid can splash out from the hole while the cup is being carried or spill out in no more than minor amounts even if the cup is tipped over. Other lid openings include drain holes—that are conventionally located adjacent to the drink through aperture and are recessed and sized to allow liquid to flow back into the cup from above the lid recess area when too much is discharged.

The applicant's own co-pending application Ser. No. 08/529,061 filed on Sep. 15, 1995, and for which U.S. Pat. No. 5,657,898 was granted on Aug. 19, 1997 teaches an upwardly extending protrusion forming a retaining chamber into which a filter bag may be drawn and having an aperture that, due to its small size, does not allow the bag the bag to be easily extricated therethrough.

A number of disadvantages are associated with the conventional apparatus and systems intended to facilitate the consumption of beverages from a cup. Many are complicated structures that are relatively costly to manufacture and use. Many such apparatus and systems do not readily stack thereby making them more costly to ship and store. Many require other equipment—such as a straw or spout—to allow the liquid in the container on which the apparatus is fitted to be consumed from the container as intended.

Regarding conventional apparatus and systems directed to facilitate the preparation of beverages, a number of disadvantages are associated with them. Some of these will be discussed.

Some conventional preparation apparatus typically do not allow beverages to be produced quickly but instead require extensive, pre-use preparations and/or a series of manipulations so that the apparatus may be operated as intended. These include looping of cords and unfolding and folding of a sheet of covering material. Such complications limit the usefulness of the apparatus in circumstances where the preparer has a limited amount of time to spend on the preparation process—such as in a carry-out food and/or beverage operation.

Many conventional preparation apparatus typically do not allow beverages to be produced from a conventional beverage bag. Many conventional apparatus are combinations of covers and bags or utilize bags made only for such apparatus. Such cover/bag combinations limit the type of beverages that may be made with the apparatus. Other conventional preparation apparatus and conventional beverage cups or other containers do not provide the means by which a bag can be held in place relative to the liquid during the steeping process and even when the beverage is being consumed.

Many conventional preparation apparatus grip or have secured to it one portion of the walls of the conventional sized beverage bags such that the distance at which any portion of the beverage bag can extend below the surface of the apparatus is not freely adjustable. As a result, such conventional apparatus cannot be used to prepare a beverage in containers in which the liquid level cannot be brought close enough to the rim of the container so that the beverage bag can actually contact the liquid. When such conventional preparation apparatus are fitted on a conventional container that allows the liquid to be brought to nearly the mouth of the container, a dangerous situation may develop. The liquid may more easily splash out from any openings in the conventional apparatus and, if hot, injure the person preparing, serving, or consuming the beverage and/or require clean-up. If the container that is filled has a conventional shape with small base area and an outwardly flaring surrounding wall, the container as filled nearly to the top can become more top heavy and more prone to tip over. This again may cause injury and liability. As a result, such conventional preparation apparatus should not likely be used by those on the go and not, for example, without the container and apparatus being positioned on a stable surface. Also, such conventional apparatus do not allow the gripped or attached bag to be moved relative to the depth or other inner shape of the container. Such apparatus are, as a result, best used for preparing beverages in only certain types of containers.

Many conventional preparation apparatus require the individual preparing the beverage to use both hands to support and manipulate the beverage preparation apparatus. Because the individual no longer has a free hand to hold onto the cup in which the beverage is being prepared, the beverage can be safely prepared only if the cup is stably positioned on a flat surface and not, for example, while the individual is in the process of serving the beverage or while the individual, who intends to consume the beverage, is on the go and/or carrying the cup. This limits the usefulness of such conventional apparatus.

Other conventional apparatus make no provision for the storage of the used tea, coffee, or other beverage bag once the beverage has been produced. Typically, conventional preparation apparatus and methods require that the beverage bag be separated and lifted away from the cup and either placed on another surface or in another container for possible reuse or disposal. The failure to provide a quick and convenient sanitary storage place for the used bag with or on the cup in which the beverage is produced increases the likelihood that additional clean up will be necessitated. Also, conventional apparatus that fail to provide such sanitary storage cannot be easily used by an individual on the go without at least the bag being improperly discarded.

A demand therefore exists for a simplified beverage preparation and retention apparatus and methods by which a beverage can be prepared according to the individual tastes of the consumer in a variety of containers from a bag sanitarily and without the need for the operator to, for example, directly contact or squeeze the bag and, after the beverage is prepared, provide for the quick and easy storage of the bag within the apparatus such that the beverage can be consumed even with the apparatus in place on the container. The present invention satisfies the demand.

The apparatus of the present invention are lids—termed retainers also herein —by which the preparation of a beverage within a container may be individually controlled by movement of a string attached to a beverage bag relative to the retainer and the liquid within the container. The retainer is sized and shaped to form a cover over the mouth of a container and that is structured to be openable or is open and such that a bag from which the beverage is to be prepared can be adjustably retained in a wide variety of positions relative to the retainer—thereby permitting the retainer to be used to prepare beverages in containers having a variety of internal shapes and sizes and that are partially or completely filled with liquid. Such containers include those in which the surface of the liquid may be at a wide variety of distances from the container mouth and whose depth varies. Embodiments of the retainer vary in profile and the position of the bag retention structure. The retainer is further structured such that the bag may be easily moved to a generally elevated position relative to the surface of the beverage to stop the steeping process and releasably secured there so that the beverage can be consumed even with the apparatus and elevated bag in place.

In certain preferred embodiments of the present invention, the elevational retainer includes a bag retention structure that is movable and openable by the application of pressure on or adjacent to the retention structure. In certain preferred embodiments of the openable retention structure, the structure includes a patterned area such as weakenings or cuts made in or through the cover material that can be opened to provide an aperture with opposing resilient gripping edges by which a beverage bag can be secured to the retainer. In such movable and openable embodiments, the bag may be initially secured to the retainer, for example, by applying a relatively reduced amount of pressure at the patterned area—such as at the inner retainer surface or abutment surface described more completely below—so that the area is opened only slightly in order that the string—and if the string has one, the tag—can be only be drawn through the resultant string/tag securing aperture. In these embodiments, the string and/or tag may be gripped by the opposing gripping edges that may define the size and shape of the aperture such that the bag is suspended at a variety of distances relative to the lower inner surface of the retainer. By adjusting the point at which the opposing gripping edges grip the string or tag, the bag may be positioned within the container on which the retainer is seated at a variety of places—such as fully immersed and freely suspended within the liquid or closer to and possibly contacting the bottom of the container. When the preparation of the beverage has been completed, further contact of the bag with the beverage, and therefore further steeping can be prevented by simply pulling upward on the string and/or tag that is exposed above the upper surface of the retainer. The bag can thereby be raised from the immersion position to a position that is elevated relative to the surface of the beverage. By continuing to draw the string and/or tag upward, the bag encounters in certain embodiments the inner retainer surface—termed also abutment surface in the following—at the patterned area such that the bag and its contents are at least partially compressed and some fluid to be driven therefrom. By continuing to draw the bag upward, relatively greater pressure is placed against the abutment surface at the patterned area of the openable retention structure, causing the retention structure area to be further moved and opened outwardly so that at least an upper portion of the bag can be drawn through the opened pattern and the opposing resilient edges of the bag retention aperture area can grip and retain the bag in an elevated position without the application of any further upward pressure. During this step, additional fluid may be driven or drip from the bag. In certain of these preferred embodiments, the patterned area is structured such that it may be moved to form holding elements such as sharpened, pointed, or textured edges—as the bag is being drawn upward through the area. Such holding elements can catch the bag or, for example, the string or tag attached to the bag thereby preventing the bag from falling back into the beverage from the bag's elevated gripped position without the placement of any additional upward pressure on the bag by the consumer. This generally one-way catch advantageously further facilitates the use of the retainer to prepare beverages by those on the go and during the serving of the beverage.

In other preferred embodiments of the present invention, the elevational retainer includes a bag retention structure that is partially or completely open and may be movable. Embodiments of the partially open bag retention structure may include opposing resilient edges that by placing pressure against them may open the bag retention structure more so as to provide an open string/tag securing aperture having a shape and size such that the string of the bag and, if the string has one attached to it, the tag may be passed through the aperture yet which remain generally close enough that a space generally smaller than the transverse section of the tag and/or string is formed so that the edges may grip the string and/or tag and thereby loosely secure the bag to the retainer. The string/tag securing aperture may be sized and shaped in certain embodiments such that the aperture functions also as a vent by which the gases above the liquid in the container can be exchanged with those outside the container area. The string/tag securing aperture may be generally placed within a patterned area such that by drawing the string upward, the bag makes contact with and is compressed against the abutment surface of the retainer below and adjacent to the patterned area causing the string/tag securing aperture to generally enlarge so as to provide a bag retention aperture of sufficient size and shape such that a least an upper portion of the bag can be retained in an elevated gripped position. A string/tag securing aperture that is centrally placed within the patterned area allows the area to be opened generally uniformly. Other embodiments of the partially open bag retention structure include an open string/tag securing aperture—having opposing edges that are spaced apart from each other and of a shape and size such that the string and/or tag may be passed through it and the bag thereby loosely secured to the retainer plus a separate openable or open string engaging portion into which the string of the bag may be drawn and by which the string may be gripped once the bag is positioned at the desired elevation relative to the liquid within the container and the retainer.

Embodiments of the open bag retention structure include a bag retention aperture having opposing gripping edges that are spaced apart from each other and are sized and shaped to accept a preparation beverage bag snugly without the user having to touch the bag by drawing the beverage bag by its string and/or tag from the fluid upwardly and through the aperture and retain the bag in an elevated position above the fluid level without the application of any further upward pressure being placed on the bag. The bag retention aperture of this open bag retention structure may be sized and shaped not only to allow the bag to be retained in an elevated position but also such that the same aperture can act as a vent through which gas may be vented out from or into the container. As above, such combination vent/open bag retention structure not only prevents a partial vacuum from forming under the cover and above the liquid when the beverage is withdrawn by the consumer but also allows an aroma to develop in the immediate area of the container. Such an aroma can heighten and extend the beverage consumption experience and, depending upon the aroma, act as a therapeutic agent.

Additional preferred embodiments of the present invention may include additional elements such as additional bag retention areas by which one or more additional beverage bags—either of the same or different size—may be releasably secured to the retainer. Certain such embodiments may include an additional open second bag retention area sized and shaped to accept a second beverage bag such as one that provides additional strength or flavorings to the beverage and/or provide fragrance to the area around the container to further heighten and/or extend the beverage consumption experience.

The apparatus may include an element that prevents the blockage of the drinking aperture by the elevated supported beverage bag such as when the container is rotated for drinking from it. An additional embodiment of the retainer including such a blocking element provides a wall projecting generally vertically perpendicular to the generally horizontal portion of the lower surface of the cover and between the drinking aperture and the bag retention structure. The wall of this embodiment may be formed from the same layer of material from which the elevational retainer is formed.

An advantage of the present invention is that the elevational retainer is sized and shaped such that one or more conventional tea, coffee, or other beverage bags can be used to prepare a beverage within a container quickly and easily, thereby increasing the convenience and utility of the retainer and specifically decreasing the amount of time and cost required to prepare and serve the beverage.

Another advantage of the present invention is that the retainer is sized and shaped to form a cover over the mouth of a container and structured such that a bag from which the beverage is to be prepared can be adjustably positioned at a wide variety of positions relative to the retainer. This permits the retainer to be used to prepare beverages in containers having a variety of internal shapes and sizes such as those in which the liquid level cannot necessarily be brought close to the mouth of the container and those having various depths.

An additional advantage of the present invention is that, after the preparation of the beverage has been completed, the bag may be moved from the beverage and releasably secured to a generally elevated position relative to the surface of the beverage to stop the steeping process and thereby allow a consumer to easily prepare a beverage according to his or her tastes and even reuse the bag if the consumer so chooses.

Also, an advantage of embodiments of the present invention is that the beverage bag can be moved to a retained position without the need for both of, for example, the server's or consumer's hands to be in touch solely with the apparatus. As a result, an individual can prepare a beverage from one or more beverage bags, draw the bag or bags into an elevated position within the apparatus with one hand, and use the other hand to support, in part, the container, all the while the individual is walking with and/or serving the containerized beverage. This reduces the time needed to prepare and serve and for the consumer to begin to enjoy a freshly brewed beverage.

A further advantage of the present invention is that embodiments of the present invention allow the used beverage bag to be stored within the apparatus and the beverage to be consumed through the apparatus even while the apparatus remains in a covering position on the beverage container, thereby eliminating the need for the consumer to find a another place to store, place, or dispose of the bag.

An added advantage of certain embodiments of the present invention is that the bag retainer is sized and shaped such that the wet, and therefore heavier bag can be drawn up and into a position within the retainer and generally away from the outer wall of the beverage container such that the container on which the retainer is fitted remains generally balanced and less likely to accidentally tip over.

Additionally, an advantage of the present invention is that, after the consumption of the beverage, the container with the apparatus and bag in a retained position may be discarded sanitarily and all at once thereby preventing the need for additional clean up.

A further advantage of the present invention is that the apparatus is of a simplified construction that lessens the cost of manufacturing and use. Embodiments of the apparatus can be easily stacked thereby reducing transportation costs and lessen the need for costly storage space.

An added advantage of those embodiments of the present invention in which the retainer is not open but includes features that permit the retainer to be opened as needed so that the retainer as seated on the container and unopened can slow the change in the temperature of the liquid placed in the container and when needed can be opened for preparing and serving a beverage.

It is, accordingly, a general object of the present invention to provide apparatus and methods by which a beverage may be prepared from one or more conventional bags quickly and easily and sanitarily.

It is another object of the present invention to provide apparatus and methods that permit a bag to be adjustably positioned relative to the fluid within a container such that a beverage may be prepared within containers having a variety of internal shapes and sizes.

An additional object of the present invention is to provide apparatus such that, after the preparation of the beverage, the position of the bag may be adjusted such that the bag is moved from the beverage and releasably secured at a generally elevated position relative to the beverage surface to stop the steeping process and thereby allow a consumer to easily prepare a beverage according to his or her tastes.

Also, an object of certain embodiments of the present invention is to provide an apparatus that allows a beverage bag to be moved to an elevated position without the need for both of, for example, the server's or consumer's hands to be in touch solely with the apparatus.

A further object of the present invention is to provide apparatus and methods by which a bag that is used to prepare a beverage can be supported at or above the level of the beverage in a position such that the consumption of the beverage through the apparatus is not generally impeded even with the bag in the elevated position thereby eliminating the need for the consumer to find a another temporary or generally permanent place to store, place, or dispose of the used bag.

An added object of some embodiments of the present invention is to provide apparatus and methods by which a beverage can be prepared within a container with one or more bags and the bags retained by and the gas vented into and/or out from the area adjacent to the beverage by the same retainer.

Also, an object of the present invention is to provide apparatus and methods by which a bag that is to be used to prepare a beverage within a container can be quickly and easily secured to the container for the sanitary disposal of the bag and container simultaneously.

Another object of certain embodiments of the present invention including an openable retainer structure is that the retainer as unopened can better moderate the change in temperature of the liquid after the container is filled.

A further object of the present invention is to provide an apparatus that is of a simplified construction that lessens the cost of manufacturing and use.

These and other objects, features, and advantages of this invention will be clearly understood and explained with reference to the accompanying drawings and through a consideration of the following detailed description of the preferred embodiments.

BRIEF DESCRIPTION OF THE DRAWINGS

FIG. 10A illustrates a perspective view partially in phantom of an embodiment of the present invention showing a retainer including a retention structure with complete profile having a generally flattened upper surface and a side wall generally perpendicular thereto through which two movable patterned areas may be individually opened to provide apertures such that the tag and string of each beverage bag may be drawn in part therethrough and the string drawn through and secured by the opposing edges of the narrowed string engaging portion.

FIG. 10B illustrates a perspective view of the embodiment illustrated in FIG. 10A showing the retainer with both patterned areas opened and the strings of two bags secured within the narrowed string engaging portion of the apertures.

FIG. 12A illustrates an overhead view showing a retainer including a retention structure having a generally full profile and including a retention aperture sized and shaped such that the bag may be retained in a secured position or in an elevated position thereby.

FIG. 12B illustrates a cross sectional view of the retainer illustrated in FIG. 12A showing the bag retained in an elevated position.

FIG. 12C illustrates a perspective view of the retainer illustrated in FIGS. 12A and 12B showing the placement of the retention aperture in a non-centered position that is not directly opposite to the drinking aperture.

DETAILED DESCRIPTION OF THE INVENTION

Figure 1A:
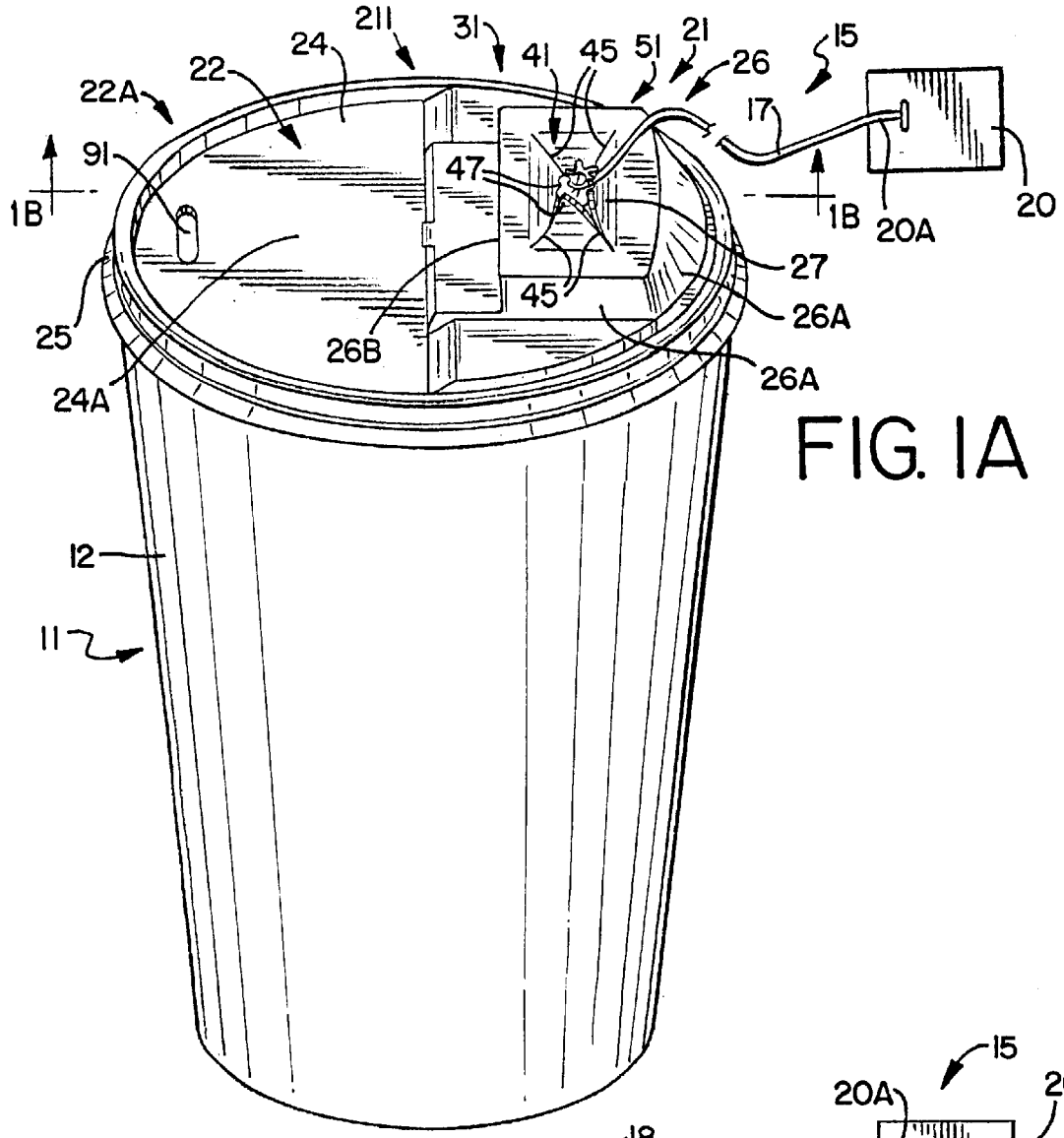
FIG. 1A illustrates a perspective view of an embodiment of the present invention showing a retainer and including a generally reduced profile movable openable bag retention structure that is partially opened and a beverage bag secured by the gripping of the bag's string by the opposing resilient edges of the retention structure.

A beverage preparation and bag retention apparatus according to the present invention is identified in the accompanying drawings as 21.

The apparatus 21—termed also "retainer" or "elevational retainer" in this application—is sized and shaped such that it may be used in conjunction with a container 11. For convenience of description, terms such as "upper", "lower", "outer", "inner", "horizontal", "vertical", and "outwardly" are used to refer to the apparatus in an orientation illustrated in the accompanying drawings. However, it will be understood that during use, the retainer 21 advantageously can be used in a variety of orientations—such as rotated while in contact with the container 11 and as the beverage within the container is being consumed.

The container 11 includes a surrounding container wall 12 having a composition and structure such that the container is suitable for holding a liquid 19. The container 11 may, however, vary in construction and be made from a variety of materials including paper, plastic or other material that is preferably inexpensive and therefore suitable for one-time disposable use or otherwise. The container wall 12 includes an outer surface 12A and an inner surface 12B that meet to form a lip 12C that defines a mouth 14A. The size and shape of the inner surface 12B—which does not necessarily always correspond directly to the size and shape of the outer surface 12A—defines an inner space 14. Because of the adjustability features of the present invention, the retainer 21 advantageously can be used with containers 11 having inner surfaces 12B of a variety of depths and shapes.

The retainer 21 includes a cover panel 22 sized and shaped such that the panel 22 may extend over the container mouth 14A in a covering position 22A. Cover panel 22 includes an upper surface 24 and opposing lower surface 23 that meet at a peripheral rim 25 and may form a surrounding edge wall 25A sized and shaped such that the retainer 21 can sit on and/or form a releasable sealingly grip on or about the lip 12C and/or the outer surface 12A and/or inner surface 12B of the side wall 12 of the container 11. A peripheral rim 25 with surrounding edge wall 25A that is sized such that the retainer 21 has an internal circumference that is less than the circumference of the outer surface 12A of the container 11 advantageously can provide generally a sealing grip between the retainer 21 and the container 11 to lessen spillage from the container. The container 11 may be filled with liquid 19 such that a supra-liquid space 14B forms between the surface 19A of the liquid 19 and the cover panel lower surface 23 of the retainer 21 when in a covering position 22A such that a bag 15 retained in an elevated position 71 by the retainer 21 may be separated from the liquid 19 and, for example, the steeping process stopped thereby.

Preferred embodiments of the retainer 21 are intended to be made at low cost such that the retainer 21 may be discarded with the container 11 and therefore is preferably integrally made from a thin resilient sheet of inexpensive material—such as a polymer—that is suitable for efficient manufacturing—such as by a thermoforming operation—yet is sufficiently strong to facilitate the bag supporting and retention steps described herein.

Preferably, the retainer 21 includes an open or openable drinking aperture 91 that may be positioned generally adjacent to the surrounding edge wall 25A through which the liquid may be drawn either directly by the consumer or indirectly such as through the use of, for example, a straw or similar apparatus. In embodiments illustrated in certain of the accompanying drawings, the drinking aperture 91 is shown as open and rounded. However, the aperture 91 may be of any size and shape such that liquid may be withdrawn from the container 11 without general loss of the liquid 11. For example, the drinking aperture 91 of the embodiment illustrated in FIGS. 11A through 11C is openable and can be opened by partially separating the covering flap 92 from the cover panel 22 and rotating the flap 92 until the consumer can easily access the liquid 19 within the container 11.

The elevational retainer 21 includes a bag retention structure 31 that, depending upon the embodiment, is openable and may be partially opened or more fully opened depending upon the pressure applied on the retention structure or is open such that a string/tag securing aperture 61 and/or a bag retention aperture 51 is provided by which a bag 15 may be releasably secured to the retainer 21 in a variety of positions relative to the retainer 21 and thereby the container 11 onto which the retainer 21 is fitted and the liquid 19 within the container 11. It is contemplated that the retainer 21 can be sized and shaped such that it may be used with many different types of containers 11 and bags 15. One of the many types of bags 15 that may be used with the apparatus 21 is shown in the accompanying drawings and includes a single sheet of porous material gathered to form a bag having a side wall 16 proportioned generously enough to accommodate tea, coffee, or other contents (not shown) therein even after the contents have been immersed and are swollen thereby. The illustrated bag includes a string 17 having a bag end 18 at which the string 17 is fastened—such as by a knotted loop 18A or with a staple (not shown)—to an upper portion 16A of the side wall 16 of the beverage bag 15. The string 17 may include a tag 20 attached at or adjacent to the free end 20A of the string 17. Tag conventionally is planar in shape and sized so that it can be pulled between a user's thumb and forefinger. However, the present invention may be used with bags having tags 20 of a variety of sizes and shapes—such as non-planar and/or dimensioned larger than the aperture 51 and/or aperture 61—to facilitate the positioning and/or retention of the bag 15 by the retainer 21. Other types of bags that may be used with the invention include those that are of a size and shape that corresponds more closely to that of the lower surface 23 of the retainer 21—such as the bag retention space 28A—and those that do not include a string and/or tag.

Certain preferred embodiments of the retainer 21 include a retention structure 31 having a string/tag securing aperture 61 through which a string 17 and/or tag 20 attached to a bag 15 may be inserted such that the bag is in a secured position 70 relative to the retainer 21, thereby permitting, for example, a consumer to move the bag 15 within the liquid 19 by use of the string 17 and/or tag 20 with less likelihood that the entire string 17 and tag 20 will fall into the liquid 19 after the consumer has released the string 17 and/or tag 20. Among these embodiments are those in which the string 17 and/or tag 20 may be releasably gripped by edges 45 of the aperture 61 such that the bag is releasably secured to the retainer 21 in a position chosen, for example, by the consumer. Such embodiments permit beverages to be prepared in containers 12 having various shaped and sized internal surfaces 12B and those that are filled to a variety of levels.

Figure 11A:
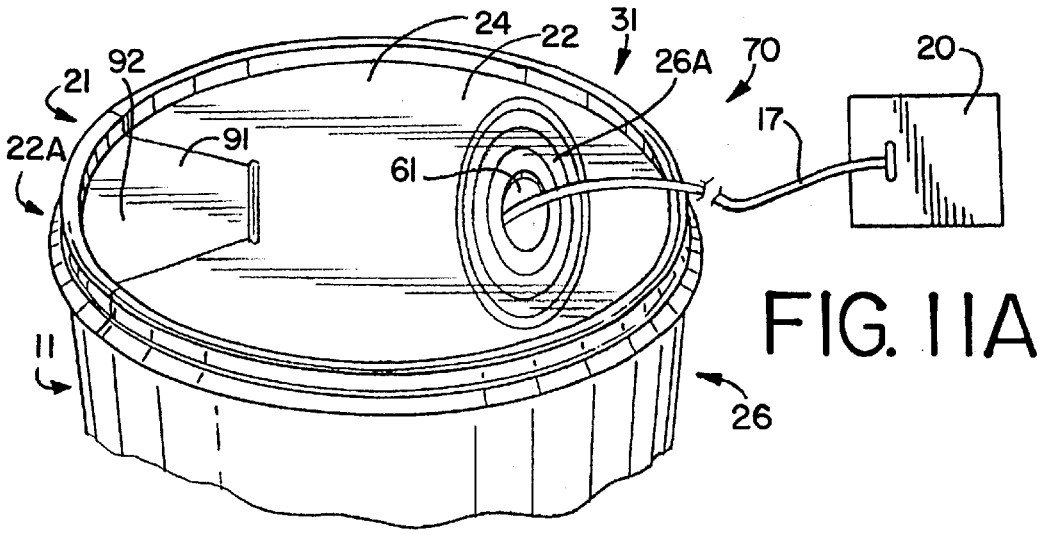
FIG. 11A illustrates a perspective view showing a retainer including a retention structure with an alterable profile, the retention structure being in a non-raised position such that the structure has a generally even profile with an open bag retention aperture by which a beverage bag may be loosely secured to the retainer and thereby to the container by the threading of the bag tag and string through the retention aperture of the retention structure.
Figure 11B:
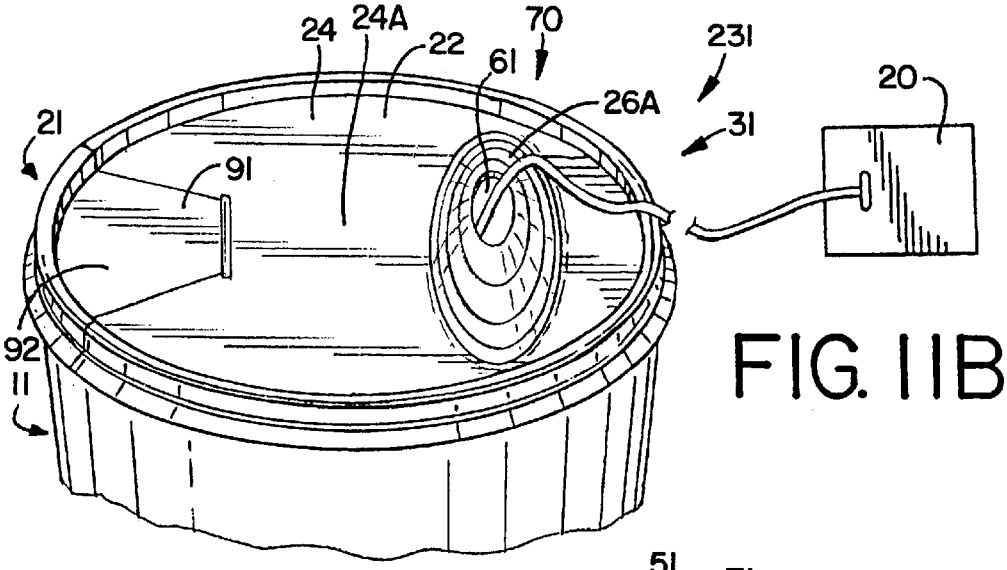
FIG. 11B illustrates a perspective view of the retainer illustrated in FIG. 11A showing the raisable retention structure in a raised position such that the structure has a generally reduced profile.
Figure 11C:
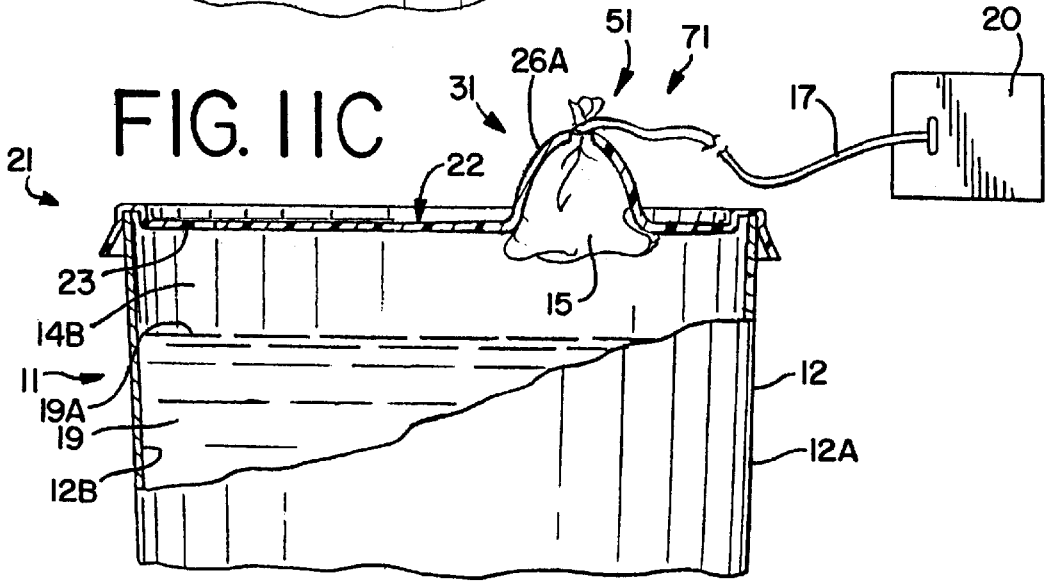
FIG. 11C illustrates a cross-section of the retainer illustrated in FIGS. 11A and 11B showing the raisable retention structure in a raised position by the drawing of the bag upward and against the lower surface of the retention structure such that the bag is retained in an elevated position by the gripping of the side wall of the bag by the opposing gripping edges of the bag retention aperture.

Preferred embodiments of the invention include those retainers 21 having a retention structure 31 with a full profile 201—such as the embodiments illustrated in FIGS. 2A and 2B, 7A and 7B, and 12A–12C—, those retainers 21 having a retention structure 31 with a reduced profile 211—such as the embodiments illustrated in FIGS. 1A and 1B and 1C and 1D—, those retainers 21 having an retention structure 31 with an even profile 221—such as those embodiments illustrated in FIGS. 3A and 3B, FIGS. 4A and 4B, FIGS. 5A–5C, FIGS. 8A–8C, and FIGS. 9A–9C—, and those retainers 21 having a retention structure 31 with an alterable profile 231 that may be moved, for example, from an even profile to a reduced profile—such as the embodiment illustrated in FIGS. 11A–C. A retention structure 31 with a full profile 201 provides an inner retainer surface 28 defining a bag retention space 28A of sufficient size and shape to accommodate a bag 15 that is of one of many different sizes and shapes even after the bag is swollen during immersion and drawn upward and held in an elevated position 71. A retention structure 31 with reduced profile 211 provides an inner retainer surface 28 that defines a bag retention space 28A of a confining size and shape such that a bag 15 of only a certain few different sizes and shapes can be drawn up into the space and squeezed due to the confinement. A retention structure 31 with even profile 221 places the retention structure 31 generally even with and not raised relative to the generally flattened upper surface 24 and provides an inner retainer surface 28 generally without a bag retention space 28A. A retainer 21 with an even retention structure profile 221 can accommodate an even wider range of bags than a retainer with a full retention profile 201. Dehydration of a bag in using a retainer with an even retention profile 221 is largely caused by the compression of the bag against the inner retention surface 28 and/or while the bag is drawn up into and releasably secured within the retention structure 31. Further embodiments of the present invention include those in which the retainer 21 has a retention structure 31 with complete retention structure profile 241—such as the embodiments illustrated in FIGS. 6A, 6B, and 6C and 10A and 10B—with one or more retention areas 26 positioned on a surrounding wall 26A of the retention structure 31. The illustrated embodiments of the retainers 21 include a nose/face accommodation area 24A between the drinking aperture 91 and the retention areas 26 that further permits a consumer to drink from the aperture 91 with generally less likelihood that the consumer will encounter a moist bag 15 retained within and exposed outward from the retainer 21. Additional details of the preferred embodiments will now be discussed.

Figure 1B:
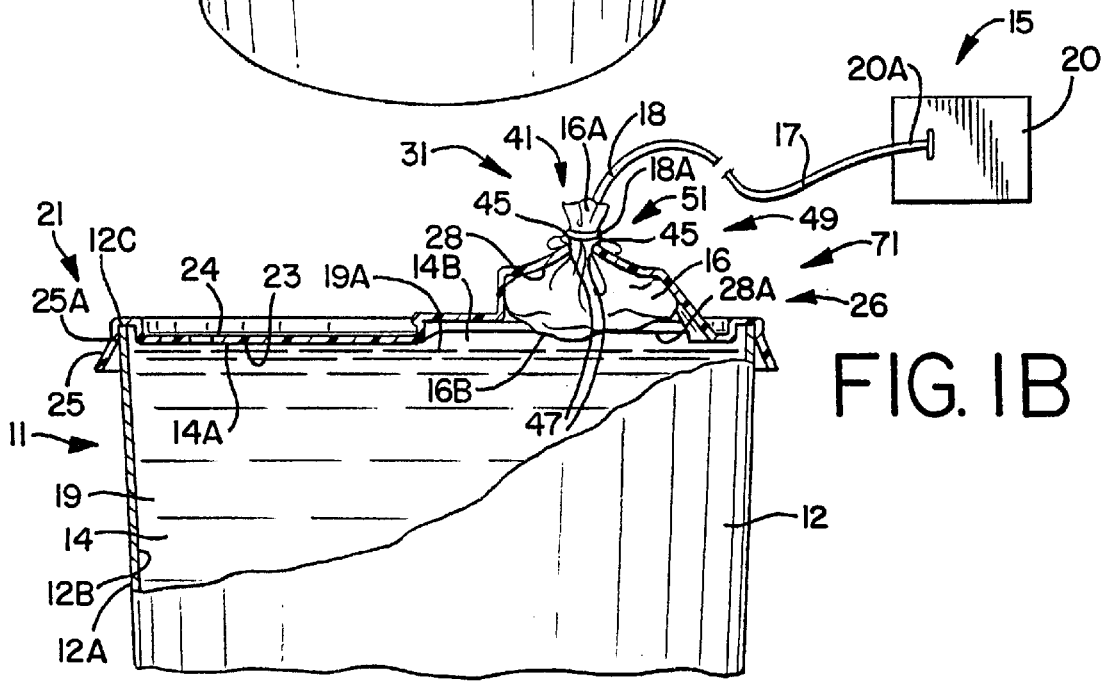
FIG. 1B illustrates a partial cross sectional view of the embodiment of the invention illustrated in FIG. 1A showing a beverage bag drawn up into a lower recess of the retainer and in part through the opened retention structure such that the bag is in an elevated position and the bag retention aperture forms generally a one-way catch for the beverage bag.

FIGS. 1A and 1B illustrate a preferred embodiment of the retainer 21 including an openable bag retention structure 31 having a reduced profile 211 that permits: a bag 15 to be adjustably placed in a secured position 70 relative to the depth of the liquid 19 in a container 11 so that the bag can be fully immersed and the steeping process can begin; the consumer to sample the container contents through a drinking aperture 91 with the retainer 21 still in place and without an interruption in the steeping process in order to determine if the beverage has been prepared according to his or her liking; and, if the preparation is completed, the bag 15 to be raised to an elevated position 71 thereby stopping the steeping process. Because of the size and shape and the placement of the accommodation area 24A relative to the structure 31 and the drinking aperture 91, the nose or other parts of the consumer's face or body do not easily come into contact with an exposed portion of the wet bag 15 while the consumer enjoys the beverage.

Specifically, the embodiment of the present invention illustrated in FIGS. 1A and 1B embodiment is a retainer 21 including a cover panel 22—with a bag retention structure 31—in a covering position 22A on a container 11. The bag retention structure 31 includes a retention area 26 that rises above the other generally horizontal portions of the upper surface 24 of the cover panel 22 in a place spaced by the accommodation area 24A away from and generally opposite to the drinking aperture 91. The retention structure 31 of the FIGS. 1A and 1B embodiment includes side walls 26A, 26B of a reduced vertical height such that the retention structure 31 is of a generally reduced profile 211 and includes an inner retainer surface 28 of a size and shape to form a bag retention space 28A in which some or all of a bag 15 that was used to prepare the beverage may be confined within the supra-liquid space 14B. The raised retention area 26 of the FIGS. 1A and 1B embodiment includes also an upper retainer surface 27 having a patterned area 41 of weakenings such as scorings formed in or perforations or incisions cut through the flexible material sheet from which the retainer 21 may be made such that the structure 31 is openable. The patterned area 41 of this embodiment can be opened partially by the application of reduced pressure at the openable patterned area 41—so as to provide a string/tag securing aperture 61—or completely—to provide a bag retention aperture 51—by the application of increased pressure at the openable patterned area 41—such as onto the inner retainer surface 28. The opening of the patterned area 41 of this embodiment, in part or entirely, exposes opposing generally pliable, yet resilient edges 45—that, depending upon the degree to which the patterned area is opened, can grip, for example, the string 17 or tag 20—such that the bag 15 is in a secured position 70 relative to the retainer 21—or the upper side wall portion 16A of the bag 15—such that the bag 15 is in an elevated position 71 relative to the retainer 21 and liquid 19. The opposing gripping edges 45 may include opposing tips 47 that are pointed or textured such that, upon the more complete opening of the patterned area 41, one or all of the tips 47 can catch the bag side wall 16 or other part of the bag 15 and further facilitate the retention of the bag in an elevated position 71 at or above the liquid surface 19A. The height at which the patterned area 41—and as a result the string/tag securing aperture 61 and the bag retention aperture 51 that may be formed therethrough—are carried relative to the liquid 19 in this embodiment and those embodiments with full profile 201, complete profile 241, or alterable profile 231 is advantageous in that the container 11 may be filled nearly to the mouth 14A and a space 28A is still provided for the storage of the bag 15.

FIG. 1A shows the retention structure 31 after the retention area 26 has been opened to a sufficient degree to permit the tag 20 and string 17 of the bag 15 to be threaded through the aperture 61 and gripped between and by the resultant opposing resilient edges 45 of the patterned area 41—thereby releasably securing the bag 15 to the retainer 21 in a secured position 70—and then to a greater degree by pulling up on the bag 15 by the tag 20 and/or string 17 until the upper side wall portion 16A of the bag 15 is between the opposing gripping edges 45 and one or all of the tips 47 catch the bag side wall 16 or other part of the bag 15 to permit the retention of the bag in an elevated position 71 at or above the liquid surface 19A.

FIG. 1B illustrates the patterned area 41 as opened—such as by the placement of upward pressure onto the inner retainer surface 28 under the openable patterned area 41 by the drawing of the bag 15 upward by the pulling on the string 17 and/or tag 20—to form a bag retention aperture 51 that is of a size and shape to accommodate an upper side wall portion 16A of the bag 15 and such that the opposing pliable resilient edges 45 of the patterned area 41 grip the side wall 16 of the bag 15 snugly and the tips 47 of the patterned area 41 catch on the side wall 16 of the bag 15 and/or the loop 18A or other portion of the bag 15. The edges 45 and tips 47 of the opened retention structure 31 shown in FIGS. 1A and 1B thereby form a one-way catch 49 that retains the bag 15 in an elevated retained position 71 at or above the surface 19A of the beverage 19. Because the bag retention space 28A in this embodiment is dimensioned to be at least equal to, but generally smaller than the dimensions of the bag 15 swollen after immersion, the process of drawing the bag 15 into this confining space and the upper portion 16A of the bag 15 through the aperture 51 may cause some liquid 19 to be squeezed from the bag 15. In such an elevated position 71, liquid 19 may also drip from the bag 15 sanitarily back into the container 11. As in the other embodiments, the storage of the bag 15 in this position 71 within the retainer 21, eliminates the need for the separate storage of the wet beverage bag 15 or the clean up of other surfaces caused by the dripping of the bag on those surfaces.

Figure 1C:
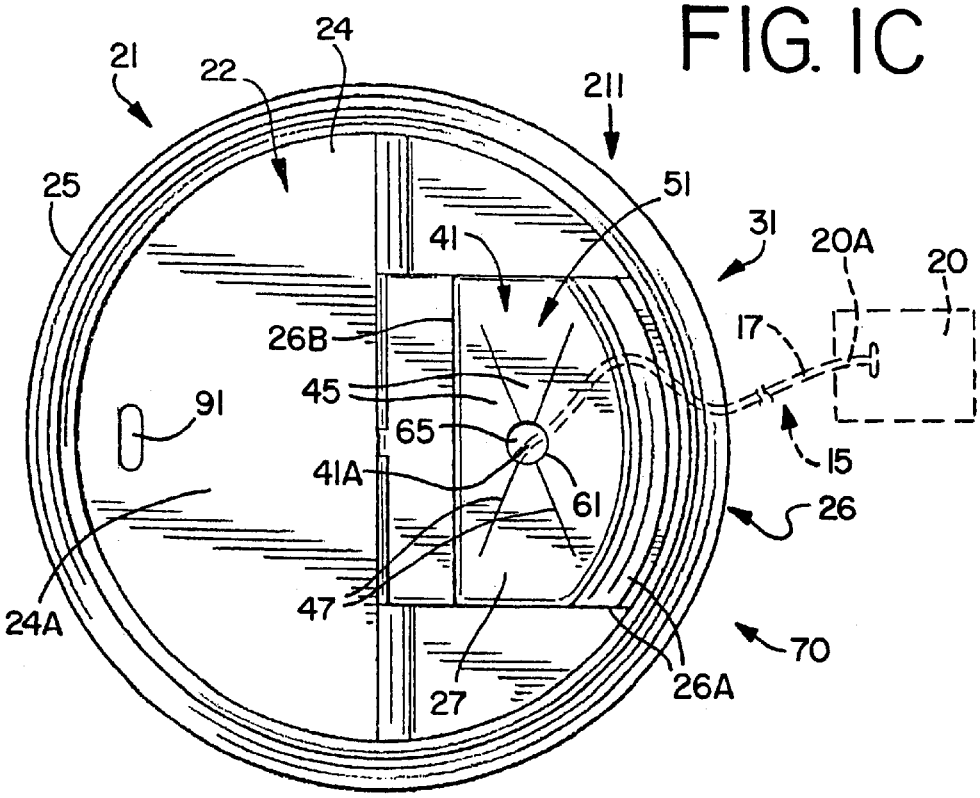
FIG. 1C illustrates an overhead of another embodiment of the present invention showing a retainer including a retention structure having a generally reduced profile that is partially opened and may be further opened and having a patterned area and an open string/tag securing aperture centrally placed therein by which a beverage bag (in phantom) may be loosely secured to the retainer and thereby to the container by the threading of the bag tag and string through the open string/tag securing aperture of the retention structure.

FIG. 1C illustrates another embodiment of a retainer 21 including a bag retention structure 31 having a reduced profile 211 that is opened in part and that can be opened further. The FIG. 1C embodiment includes, as does the FIGS. 1A and 1B embodiment, a raised retention area 26 with bag retention structure 31 having a patterned area 41 of weakenings formed in or perforations or incisions cut through the flexible cover panel 22 generally at the center 41A of which an open string/tag securing aperture 61 is positioned. The string/tag securing aperture 61 of the FIG. 1C embodiment is rounded in shape and sized such that at least the string 17 (in phantom) and, depending on its size and shape, the tag 20 in unfolded or folded state (also in phantom) can be threaded therethrough generally without further opening of the pattern 41 and the bag 15 thereby loosely secured to the apparatus 21 in a secured position 70 and so that the portions of the string 17 and tag 20 that are above the surface 24 of the retainer 21 allow a consumer to easily move and remove the bag 15 as needed. A string/tag securing aperture 61 that is sized larger than the cross sectional dimensions of the string 17—such as the securing aperture 61 shown in FIG. 1C—is advantageous in that the securing aperture 61 even with string 17 threaded therethrough can function also as a vent 65. Vent 65 permits the pressure within and outside the container 11 to equalize thereby allowing a consumer to easily sample or drink from the covered container without a vacuum forming within—and for gases and aromas to exit from within the container 11, thereby possibly increasing the beverage consumption experience. As in the FIGS. 1A and 1B embodiment, the application of pressure at the patterned area 41—such as on the inner retainer surface 28—of the FIG. 1C embodiment permits the area 41 to be opened to provide a bag retention aperture 51 such that at least a portion 16A of the bag 15 can be drawn therethrough and the opposing resilient edges 45 and/or tips 47 of the patterned area 41 to form a one-way catch 49 such that the bag 15 can be retained in an elevated retained position 71 at or above the surface 19A of the beverage 19.

Figure 1D:
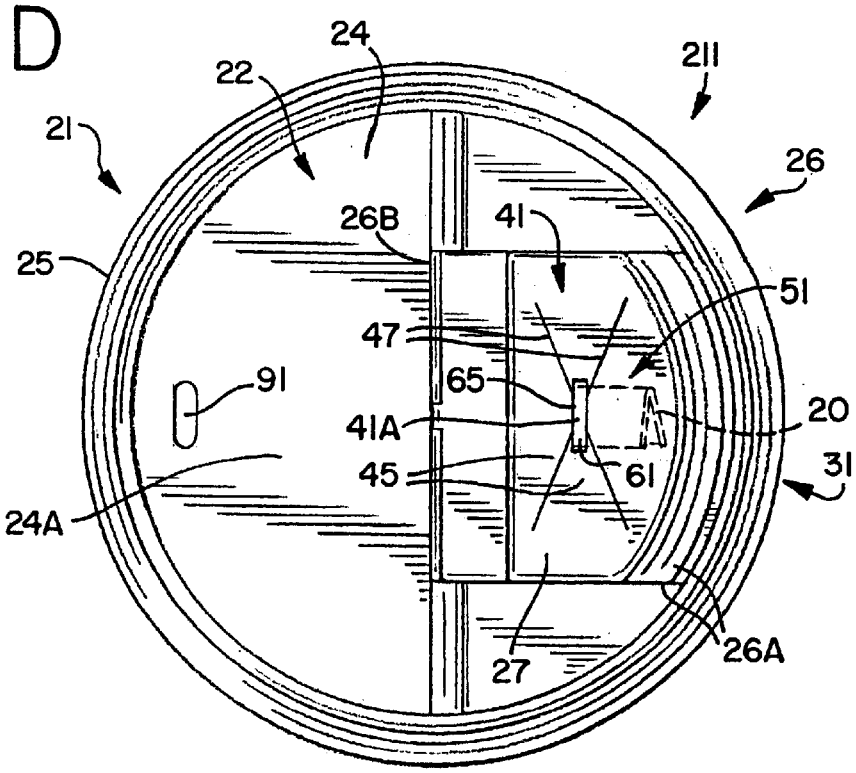
FIG. 1D illustrates an overhead of another embodiment of the present invention showing a retainer including a generally reduced profile partially opened bag retention structure that may be further opened and having a patterned area and an open string/tag securing aperture centrally placed therein showing a side view of the tag of a conventional beverage bag (in phantom), the tag being folded such that the tag and the string of the beverage bag may be threaded through the string/tag securing aperture in order that the bag may thereby be loosely secured to the retainer without at least initially any additional opening of the retention structure.

FIG. 1D illustrates another embodiment of a bag retention structure 31 having a reduced profile 211 that is opened in part and that can be opened further and that includes an open string/tag securing aperture 61 that is sized and shaped to facilitate the threading of a tag 20 therethrough. The string/tag securing aperture 61 of the FIG. 1D embodiment is shown as rectangular in shape and sized such that a string 17 or a tag 20 of reduced width (not shown) or a conventional tag 20 (shown folded in phantom cross section) may be threaded therethrough and the bag 15 thereby loosely secured to the apparatus 21 in a secured position 70. As in the FIG. 1C embodiment, the size and shape of the string/tag securing aperture 61 of the FIG. 1D embodiment permits a portion of the string 17 and tag 20 to be maintained above the upper surface 24 of the cover panel 22 to facilitate easy movement and positioning of the bag within the liquid and the easy withdrawal of the bag 15 through the area 41. Because of the size and shape of the aperture 61, it may function also as a vent 65 even with the string 17 threaded therethrough. As in the FIGS. 1A, 1B, and 1C embodiments, the application of reduced pressure at the openable patterned area 41—such as on the inner retainer surface 28—allows the patterned area 41 to be opened to increase the size of the aperture 61 and thereby permit, for example, the tag 20 to be easily passed therethrough or by the application of greater pressure at the patterned area 41—such as on the inner retainer surface 28—to provide a bag retention aperture 51 though which at least a portion 16A of the bag 15 can be drawn and the bag retained in an elevated position 71 by the edges 47.

Figure 2A:
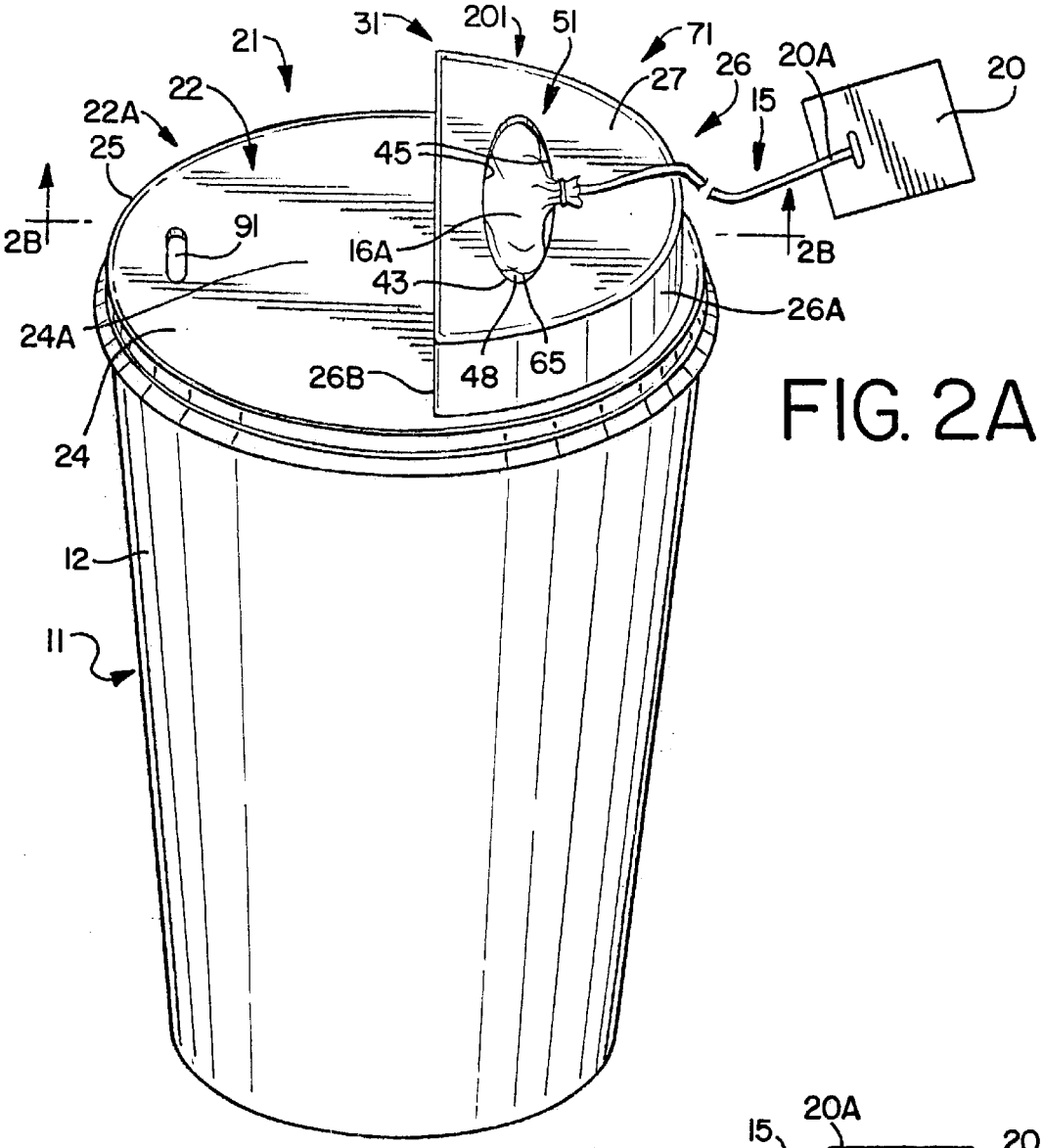
FIG. 2A illustrates a perspective view of an embodiment of the present invention showing a retainer including a full profile open retention structure having a shaped bag retention aperture through which an upper bag portion is drawn and thereby retained in an elevated position by the gripping of the side wall of the bag by the opposing resilient gripping edges of the bag retention aperture and such that a gap may be provided for venting gas from within the container.
Figure 2B:
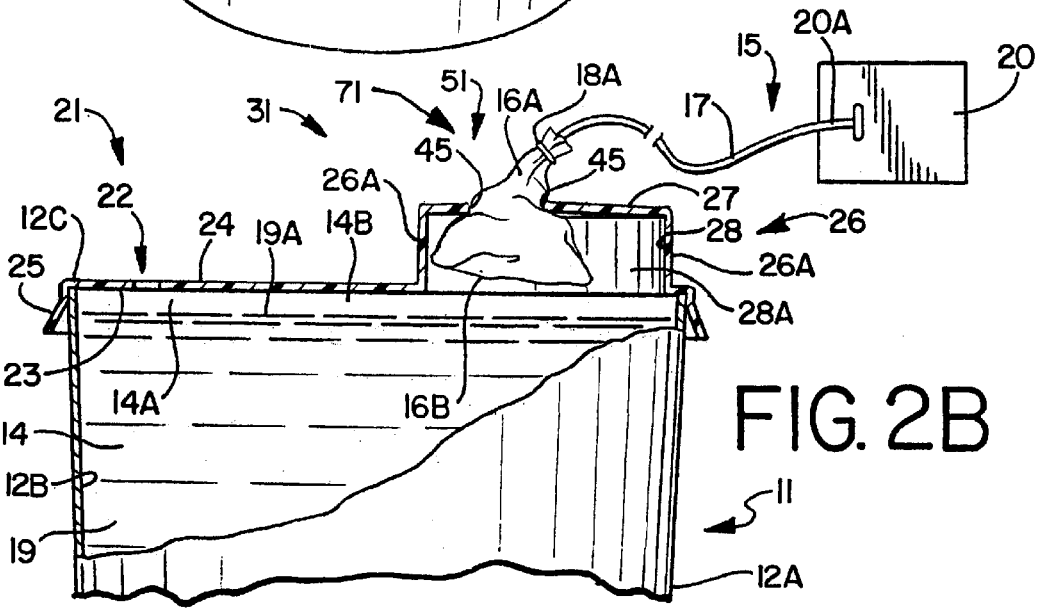
FIG. 2B illustrates a partial cross sectional view of the embodiment illustrated in FIG. 2A showing the beverage bag retained by the bag retention aperture in an elevated position.

FIGS. 2A and 2B show another preferred embodiment of the retainer 21 including an open bag retention structure 31 having a full profile 201 that permits a bag 15 to be adjustably placed in a generally secured position 70 for the controlled preparation of a beverage and when the beverage preparation has been completed to draw the bag 15 up into an elevated position 71. The retention structure 31 of this embodiment including surrounding side walls 26A, 26B. Surrounding wall 26A rises in a curve adjacent to peripheral rim 25 and generally opposite to the drinking aperture. Wall 26B meets surrounding wall 26A and is linearly aligned to generally face the drinking aperture 91. Horizontally connecting the side walls 26A, 26B is a generally flat upper retainer surface 27 that includes a retention area 26 that collectively define the full profile 201 and provide a bag retention space 28A of sufficient size and shape to accommodate generally without squeezing confinement a bag 15 that can be one of many different sizes and shapes even after the bag is swollen after immersion within the container 11 and drawn upward and held in an elevated position 71.

The open bag retention structure 31 of the FIGS. 2A, 2B embodiment includes a shaped bag retention aperture 51 that is positioned generally centrally within the raised area 26 and spaced away by the accommodation area 24A from and generally opposite to the drinking aperture 91. Bag retention aperture 51 is sized and shaped such that the string 17 and tag 20 of a bag 15 can be easily and quickly threaded therethrough generally without folding of the tag 20 and so that the string 17 and tag 20 are loosely retained above or adjacent to the surface 24 of the retainer 21 and the bag 15 is loosely held in a secured position 70 to the apparatus 21 and the container 11 on which the apparatus 21 is fitted. The tag 20 and string 17 as exposed above the surface 24 of the retainer 21 in position 70 permit the consumer to easily manipulate the bag 15—such as to raise and lower the bag 15 while it is immersed in order to speed up the beverage preparation process and to raise the bag 15 into an elevated position 71. The illustrated aperture 51 is of a size and shape also such to permit the generally upper side wall portion 16A of the bag 15, whose contents are swollen by the immersion process, to be drawn up and through the aperture 51—by pulling upward on the such that the opposing resilient gripping edges 45 of the aperture 51 grip the bag 15 at or near the side wall portion 16A and thereby retain the bag 15 in an elevated position 71. While the open retention aperture 51 may be of a variety of shapes, the retaining aperture 51 of the FIGS. 2A and 2B embodiment is rounded in shape. An aperture 51 having a rounded shape is advantageous in that a bag 15 pulled through such an aperture does not encounter any sharpened edges or tips that may puncture, tear or otherwise damage what may be a fragile surrounding wall 16A of the bag. An aperture 51 having the illustrated oval shape is further advantageous in that an upper portion 16A of an appropriately sized bag 15 may be pulled through the aperture 51 and a gap 48 may form between the bag 15 and the generally vertical aperture side wall 43 of the aperture 51. Such a gap 48 can function as a vent 65 so that the gases that form within the container 11 can be exchanged with those outside the container and vice versa even with upper portion 16A of the bag retained in an elevated position 71 within the aperture 51. Such a vent 65 allows liquid to be withdrawn from the container 11 freely and such that vacuum-like conditions do not easily form within the container.

FIG. 2B provides a cross sectional view of the embodiment illustrated in FIG. 2A further showing the retention of the beverage bag 15 by the opposing resilient edges 45 of the bag retention aperture 51 such that the bottom side wall portion 16B of the bag 15 is above the surface 19A of the liquid 19 and generally within the bag retention space 28A of the supra-liquid space 14B and contacting the inner retainer surface 28. The bag retention space 28A of this full profile 201 embodiment can accommodate many different sized and shaped bags 15 generally without confinement.

Figure 3A:
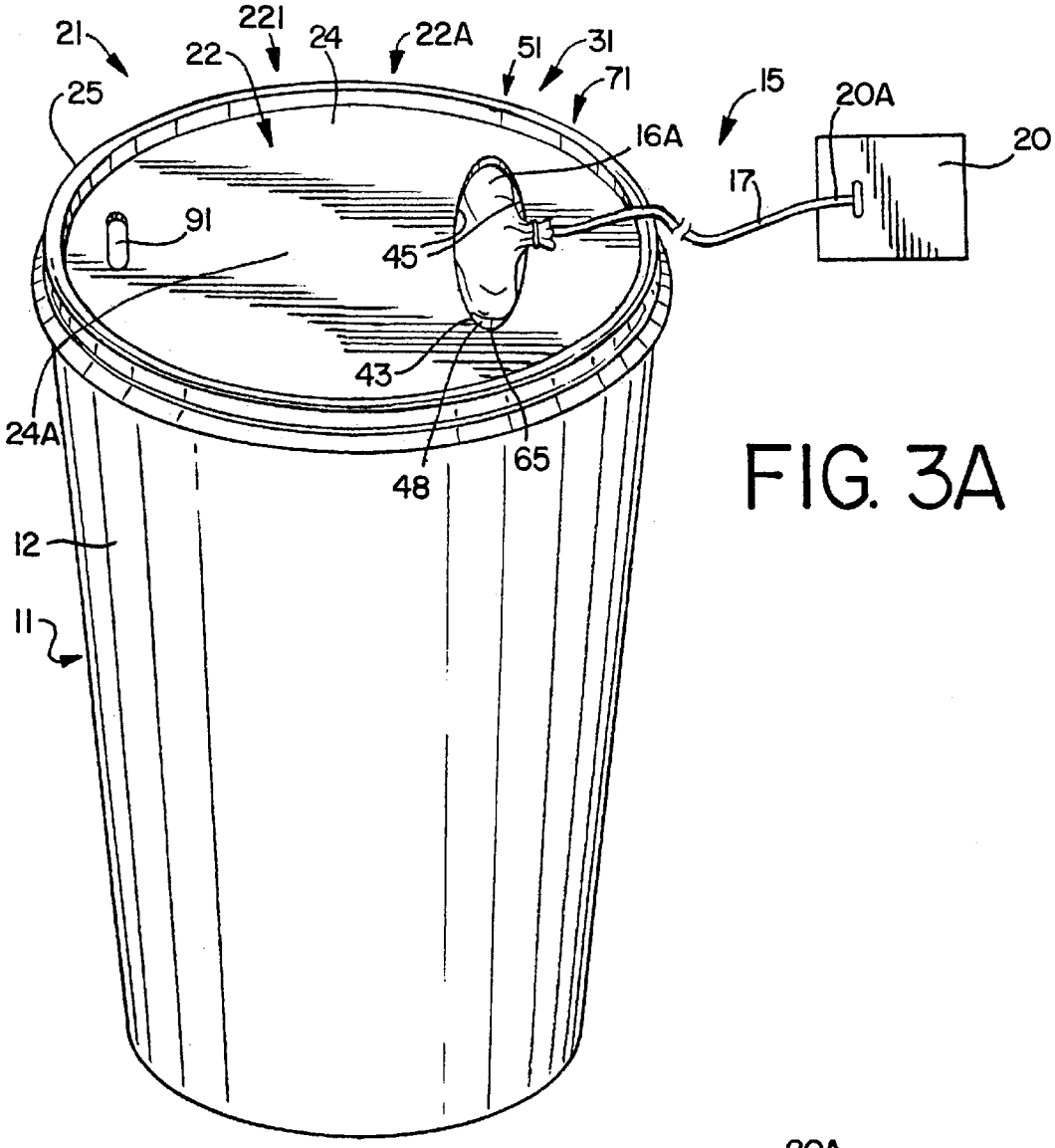
FIG. 3A illustrates a perspective view of an embodiment of the present invention showing a retainer including a generally even profile open retention structure with shaped bag retention aperture through which a beverage bag is partially drawn and thereby retained in an elevated position by the gripping of the side wall of the bag by the bag retention aperture.

FIG. 3A shows another embodiment of a retainer 21 including a cover panel 22 having a generally flattened upper surface 24 and an open bag retention structure 31 with even retention structure profile 221. This embodiment permits the bag 15 to be placed in a generally secured position 70 for controlled brewing of a beverage and, when the beverage has been completed, the bag 15 to be drawn up into an elevated position 71. As in other embodiments with an even profile 221, this embodiment places the retention structure 31 generally even with and not raised relative to the generally flattened upper surface 24 and provides an inner retainer surface 28 generally without a bag retention space 28A. The retention structure 31 includes a shaped open bag retention aperture 51 that is sized and shaped such that the string 17 and tag 20 of a bag 15 can be easily and quickly threaded therethrough generally without folding of the tag 20 and so that the string 17 and tag 20 are loosely retained above or adjacent to the surface 24 of the retainer 21 and the bag 15 is loosely secured in position 70 to the apparatus 21 and the container 11 on which the apparatus 21 is fitted for the easy manipulation of the bag 15. The illustrated aperture 51 is of a size and shape also such to permit generally an upper side wall portion 16A of the bag 15, whose contents are swollen by the immersion process, to be drawn up and through the aperture 51—by pulling upward on the string or tag such that the opposing resilient gripping edges 45 of the aperture 51 grip the bag 15 at or near the side wall portion 16A and thereby retain the bag 15 in an elevated position 71. As with the FIGS. 2A, 2B embodiment, the generally rounded shape of the aperture 51 advantageously lessens the likelihood that the aperture 51 may cause the bag 51 to rupture while it is being drawn into and partially through the aperture 51. The oval-shaped aperture 51 advantageously facilitates the development of a gap 48 between the bag side wall 16 and the opposing resilient edges 45 that can function also as a vent 65. The open aperture 51 of the FIGS. 3A and 3B embodiment of the retainer 21 is spaced by the accommodation area 24A away from and generally opposite to the drinking aperture 91 such that it is less likely that the consumer will come into contact with the bag 15 as exposed in an elevated position 71.

Figure 3B:
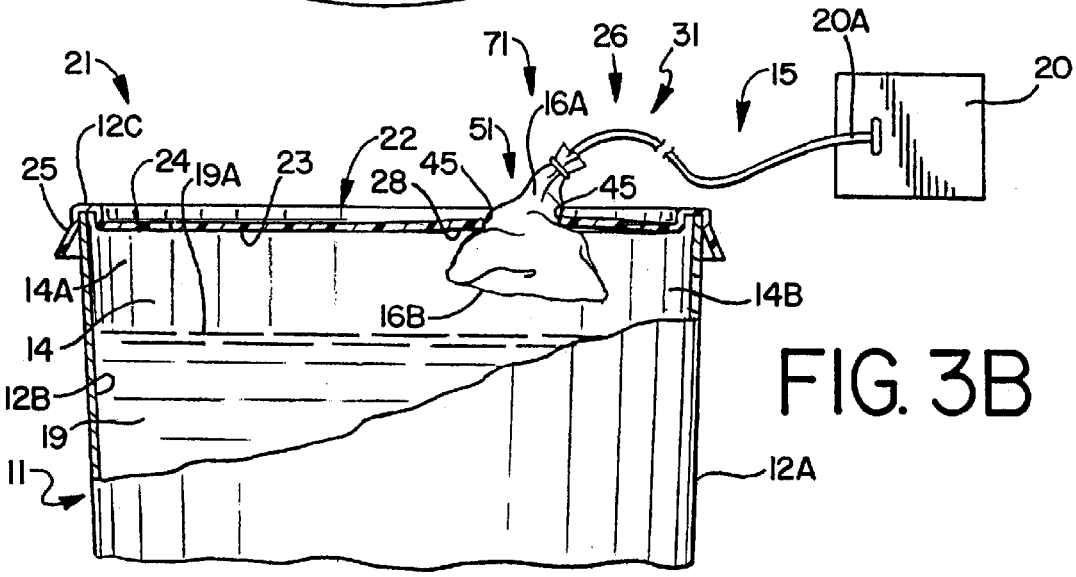
FIG. 3B illustrates a partial cross sectional view of the embodiment illustrated in FIG. 3A showing the retention of the upper bag portion in an elevated position by the bag retention aperture.

FIG. 3B provides a cross sectional view of the embodiment illustrated in FIG. 3A that shows the retention of the beverage bag 15 by the retaining aperture 51 and such that the bottom 16B of the bag 15 is generally above the surface 19A of the liquid 19 within the supra-liquid space 14B. Compression of the bag 15 against the inner retention surface 28 and/or while the bag is drawn up into and releasably secured within the retention aperture 51 causes the dehydration of the bag.

Figure 4A:
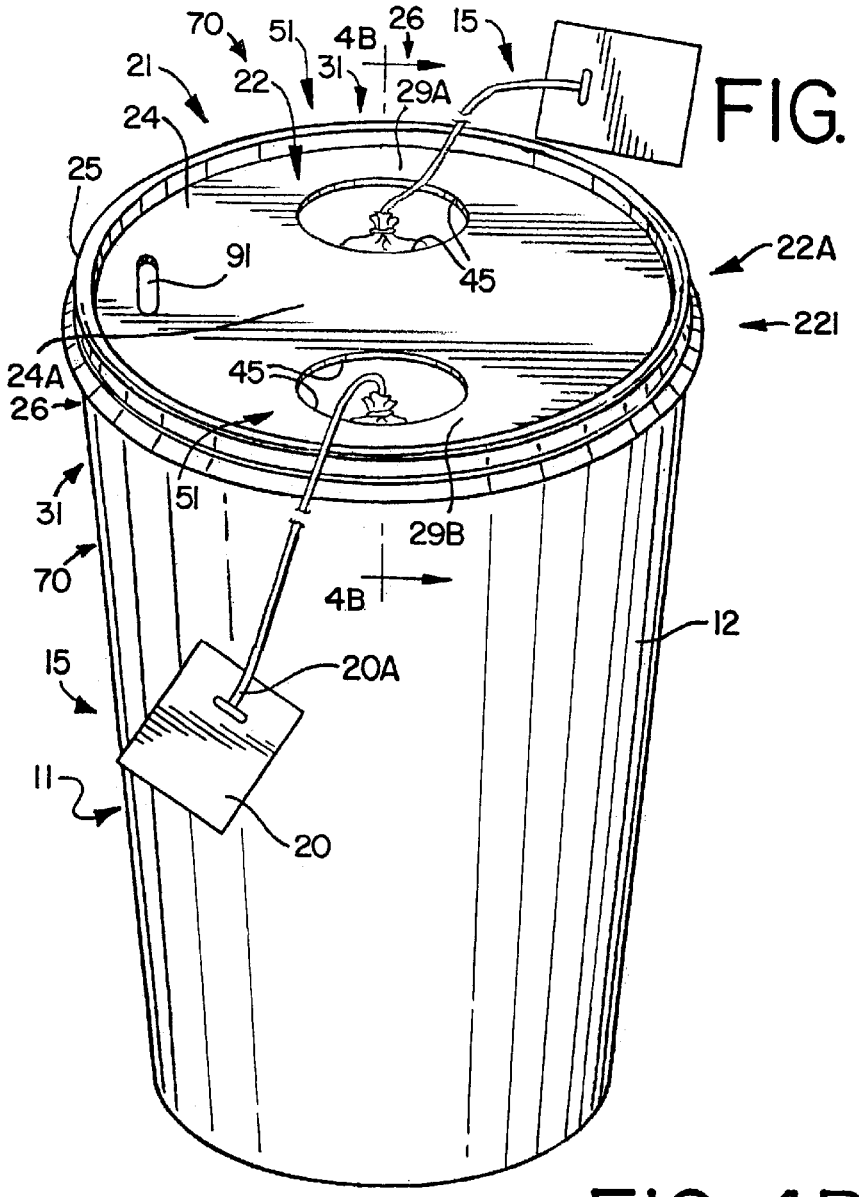
FIG. 4A illustrates a perspective view of an embodiment of the present invention showing a retainer including a generally even profile open retention structure with shaped bag retention apertures showing two beverage bags in a secured position relative to the retainer and each retention aperture.
Figure 4B:
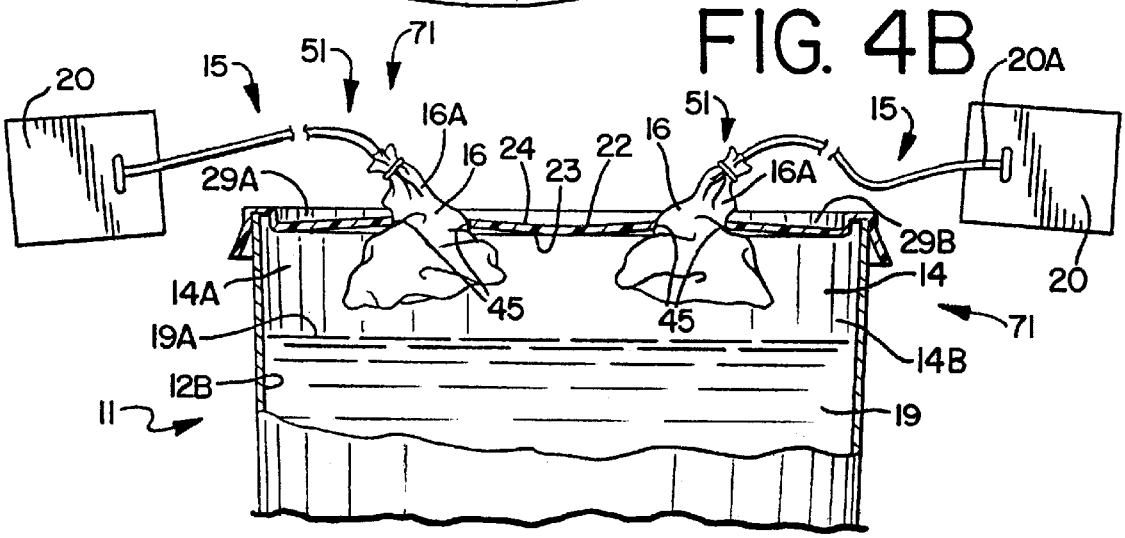
FIG. 4B illustrates a partial cross sectional view of the embodiment illustrated in FIG. 4A showing two beverage bags drawn in part through and thereby retained in an elevated position by gripping of the side walls of each bag by the bag retention apertures.

FIGS. 4A and 4B show another embodiment of a retainer 21 including a cover panel 22 having a generally flattened upper surface 24 and an open bag retention structure 31 with even retention structure profile 221 and two shaped bag retention apertures 51. As in the FIGS. 2A and 2B and FIGS. 3A and 3B embodiments, aperture 51 is sized and shaped to facilitate the threading of the string 17 and tag 20 of a bag 15 therethrough and the subsequent easy manipulation while in a secured position 70 and the retention of the bag 15 in an elevated position 71. Each aperture 51 includes opposing resilient edges 45 that permit one or more bags 15 to be retained in an elevated position 71. The two apertures 51 of this embodiment advantageously facilitates, for example, the preparation of a beverage 19 that may require two separate flavoring agents stored in separate bags 15. Such a beverage may be one that is made, for example, from a bag 15 containing tea or coffee and another bag 15 containing another flavoring agent such as a "booster" that provides a stronger or heightened or varied flavor to the beverage.

The apertures 51 of the embodiment of the retainer 21 illustrated in FIGS. 4A and 4B are aligned to open through opposite portions 29A and 29B of the cover panel 22 and spaced by the accommodation area 24A away from the drinking aperture 91 such such that the nose of a consumer that is drinking beverage through the drink aperture 91 is less likely to encounter either or both of the bags pulled up and within the apertures 51. Placement of the two apertures 51 on either side of the central vertical axis of the container as covered permits the container to remain generally balanced and not prone to tip over even with two swollen and therefore heavier bags retained in the elevated position 71. As with the FIGS. 2A and 2B embodiment and the FIGS. 3A and 3B embodiment, the apertures 51 of the FIGS. 4A and 4B embodiment are shown as oval in shape. Such a shape of advantageously may provide a gap 48 between the bag 15 and the opposing resilient edges 45 formed from the vertical side wall 43 of the aperture 51 that can act as a vent 65 even with the upper portion 16A of the bag 15 pulled through and within the aperture. As with the other embodiments, the drinking aperture 91 shown in the FIGS. 4A and 4B embodiment is illustrative of the many types that may be used with this embodiment.

FIG. 4B illustrates a cross sectional view of the retainer 21 illustrated in FIG. 4A showing the retention of the beverage bags 15 in an elevated position 71 and between the opposing resilient edges 45 of each of the bag retention apertures 51.

Figure 5A:
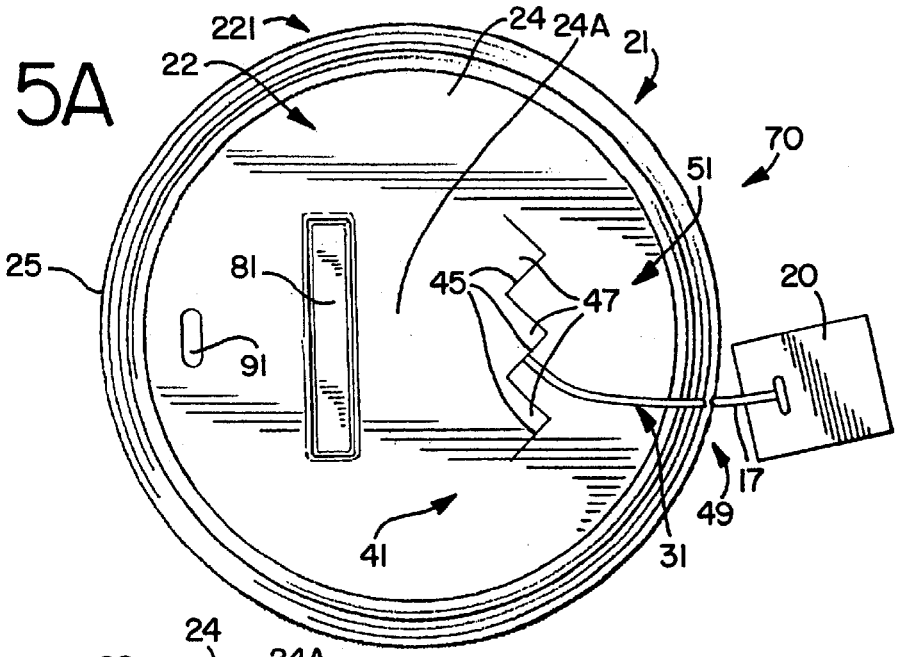
FIG. 5A illustrates an overhead view of an embodiment of the present invention showing a retainer including a generally flattened upper surface and an openable retention structure having a generally even profile and zig-zag patterned area, and a depression between the zig-zag patterned area and the drinking aperture.
Figure 5B:
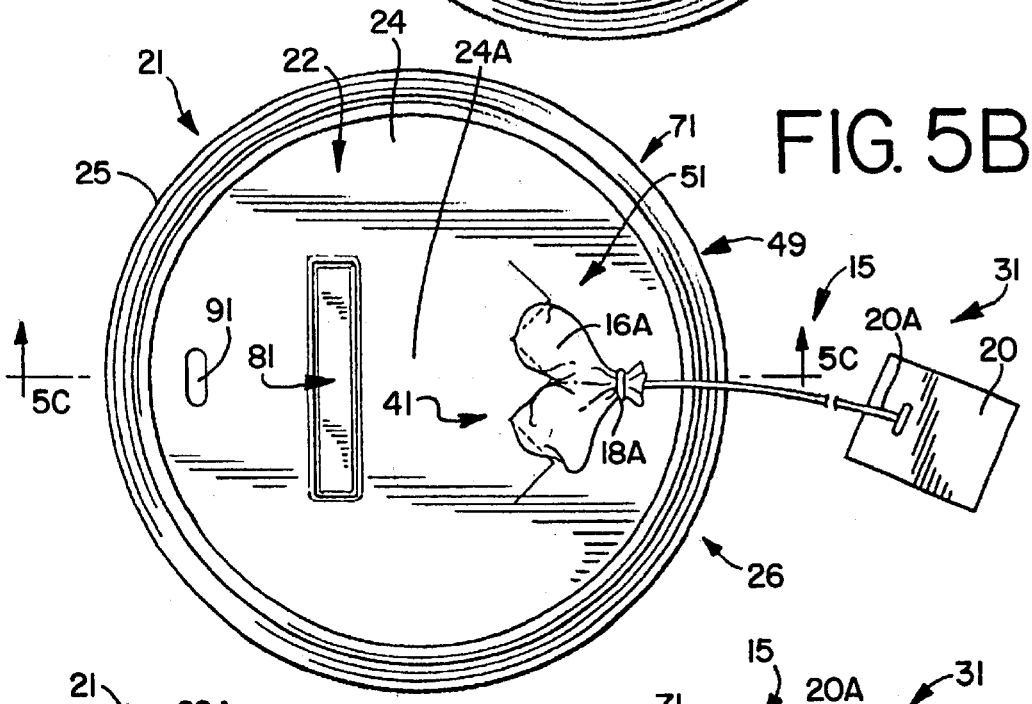
FIG. 5B illustrates an overhead view of the embodiment illustrated in FIG. 5A of the invention with the retainment structure opened and thereby forming a one-way catch for the beverage bag such that the bag is retained in an elevated position within the bag retention aperture.
Figure 5C:
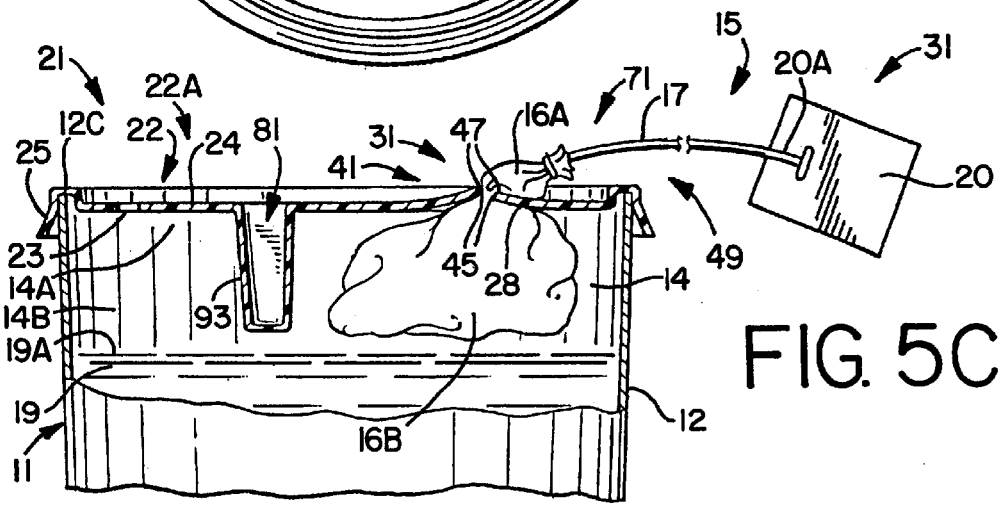
FIG. 5C illustrates a cross sectional view of the embodiment illustrated in FIGS. 5A and 5B showing the beverage bag retained by the one-way catch in an elevated position within the bag retention aperture and a wall projecting generally vertically perpendicular downward from to the generally horizontal portion of the lower surface of the retainer.

FIGS. 5A through 5C show another embodiment of the retainer 21 having a generally flattened upper surface 24 and an openable retention structure 31 with an even retention structure profile 221. The bag retention structure 31 of this embodiment includes a patterned area 41 of weakenings formed in or perforations or incisions cut through the flexible cover panel 22—such as the illustrated zig-zag pattern—that can be opened partially or completely to provide a string/tag securing aperture 61 or completely to provide a bag retention aperture 51 by the application of respectively increasing amounts of pressure at the patterned area 41. By application of a relatively reduced amount of pressure at the patterned area 41, the area may be partially opened. The partial opening of the patterned area 41 of this embodiment as shown in FIG. 5A exposes, in part or entirely, opposing resilient edges 45—that, can grip, for example, the string 17 at any point along its length or the tag 20, thereby permitting the bag 15 to be placed at a variety of secured positions 70 relative to the retainer 21. By application of greater pressure at the openable pattern 41, such as by drawing the bag upward against the lower retention surface 28 below the patterned area 41 after the steeping process has been completed by pulling upward on the string and/or tag, the bag 15 is compressed against the retention surface 28—causing the bag to be at least partially dehydrated—and the pattern 41 to be opened even more. The bag 15 can then be drawn in between the opposing resilient edges 45 such that the bag upper side wall portion 16A of the bag 15 is gripped and the bag 15 is retained in a position 71 that is elevated relative to the liquid surface. The opposing gripping edges 45 may include opposing tips 47 that are pointed or textured such that, upon the more complete opening of the patterned area 41, one or all of the tips 47 can catch a portion on the upper portion 16A of the bag 15 and/or the loop 18A or other portion of the bag 15 thereby forming a one-way catch 49 that retains the bag 15 in a elevated position 71 at or above the surface 19A of the beverage 19.

The retainer 21 of this invention may include additional means to further restrict the movement of a bag such as to prevent a retained or elevated bag from blocking another retainer passage such as the drinking aperture 91. FIGS. 5A through 5C embodiment includes a depressed area 81 in the upper surface 24 of the cover panel 22 that extends vertically perpendicular and downward relative to the lower surface 23 thereby forming a wall 93 sized and shaped such that, when a bag 15 is secured by the string/tag securing aperture 61 or a portion 16A of the bag 15 is pulled through the bag retention aperture 51, the bottom portion 16B of the bag 15 is prevented from blocking the drinking aperture 91 even when the container 11 is rotated for drinking. Such a wall 93 advantageously may be formed from the same sheet of material used to form the cover panel 22.

FIG. 5B shows an overhead view of the embodiment illustrated in FIG. 5A. More specifically, FIG. 5B shows the patterned area 41 opened after a relatively greater amount of pressure has been applied at the area 41 such that the upper portion 16A of a beverage bag 15 is drawn through and retained in an elevated position 71 by the gripping of the side wall 16A of the bag 15 by the opposing resilient edges 45 and the tips 47 of the patterned area 41.

FIG. 5C shows a cross sectional view of the embodiment illustrated in FIGS. 5A and 5B and in particular the beverage bag 15 drawn in part through and thereby retained in an elevated position 71 within the supra-liquid space 14B by the patterned area 41 and the wall 93 extending vertically perpendicular to the other portions of the lower surface 23 of the cover panel 22.

Figure 6A:
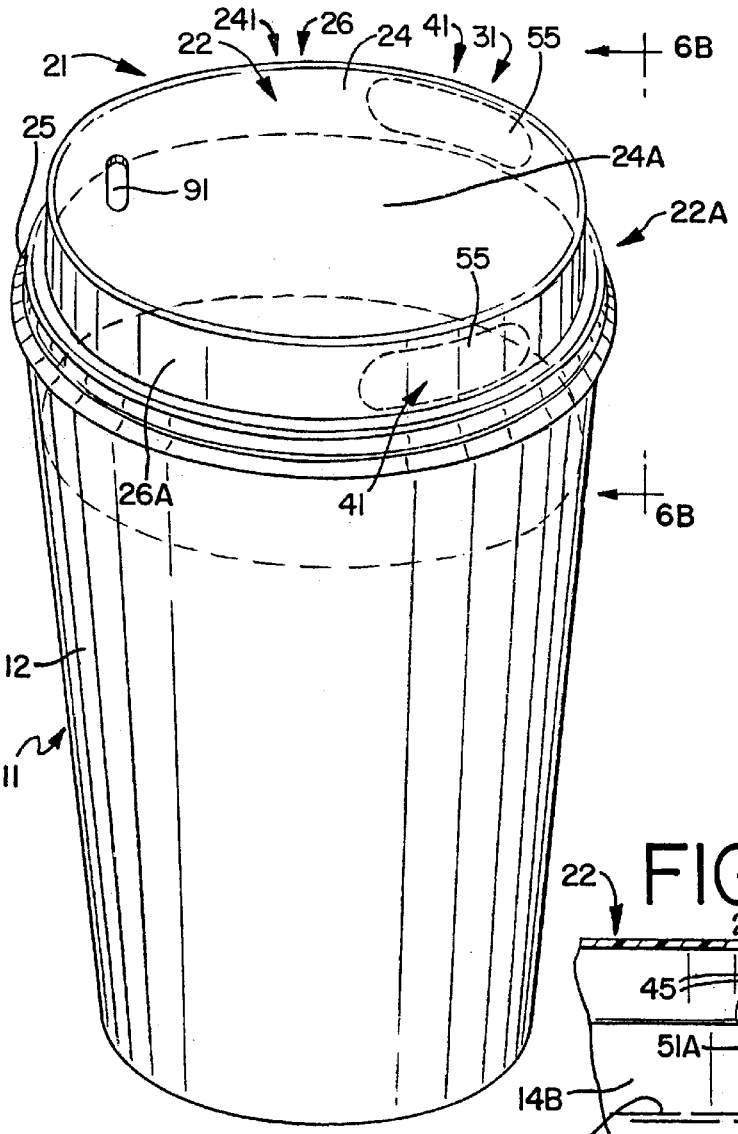
FIG. 6A illustrates a perspective view partially in phantom of an embodiment of the present invention showing a retainer including a retention structure with complete profile having a generally flattened upper surface and a side wall generally perpendicular thereto through which two movable retention areas are individually openable such that one or two beverage bags may be drawn in part through and thereby retained in an elevated position by gripping of the side walls of each bag by the bag retention apertures.

FIG. 6A illustrates an embodiment of the retainer 21 including a cover panel 22 with retention structure 31 with complete profile 241 having a generally flattened upper surface 24 and a side wall 26A generally perpendicular thereto through which two movable patterned areas 41 are individually openable such that at least the tag 20 and/or string 17 of one or two beverage bags 15 may be drawn in part through thereby retaining the bag or bags 15 in a secured position 70. Each patterned area 41 includes weakenings—formed in or perforations or incisions cut through the surrounding side wall 26A of the flexible cover panel 22—that define an aperture cover 55. By the application of pressure at the patterned area 41—such as onto the inner retainer surfaces 28 at or adjacent to one or both openable patterned areas 41—, the aperture cover 55 of one or both is freed from the retainer 21—for subsequent disposal—and the aperture 51 of each exposed thereby. Each aperture 51 is sized and shaped to facilitate the threading of the string 17 and tag 20 of a bag 15 therethrough and the subsequent easy manipulation of the bag while in a secured position 70 and such that at least an upper portion 16A of a beverage bag 15 can drawn through and thereby retained in an elevated position 71 by the gripping of the side wall 16 of the bag 15 by the opposing resilient edges 45 of the bag retention apertures 51. The apertures 51 of the FIGS. 6A and 6B embodiment are shown as having a rounded, extended shape that advantageously may provide a gap 48, and thereby a vent 65 between the bag 15 and the vertical side wall 43 of the aperture 51 when the upper portion 16A of the bag 15 is pulled through the aperture 51. The FIGS. 6A and 6B embodiment and the FIG. 6C embodiment may include a drinking aperture 91 such as the one shown.

Figure 6C:
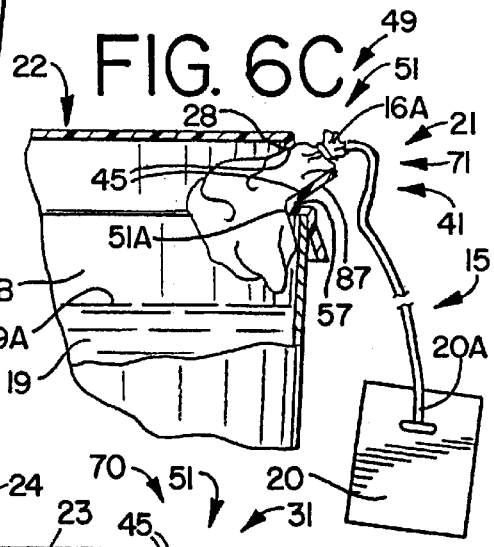
FIG. 6C illustrates a partial cross sectional view of another embodiment of the present invention showing a retainer that includes a retention structure with complete profile having a generally flattened upper surface and a side wall generally perpendicular thereto through which one or more movable retention areas may be openable showing one retention area with an openable hinged door and the retention of a beverage bag by the opened bag retention aperture.
Figure 6B:
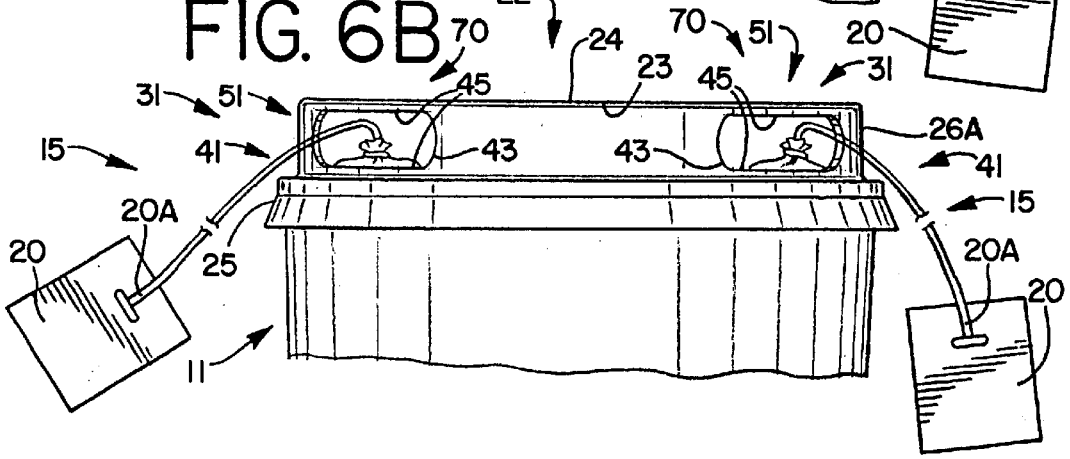
FIG. 6B illustrates a side view of the embodiment illustrated in FIG. 6A showing the retainer with both retention areas opened and beverage bags in a secured position such that they may be drawn in part through and thereby secured in an elevated position by gripping of the side walls of each bag by each of the bag retention apertures.

FIG. 6B shows the embodiment illustrated in FIG. 6A with both patterned areas 41 opened and two beverage bags 15 in a secured position 70 such that they may be further drawn in part through and thereby secured in an elevated position 71 by gripping of the side walls 16 of each bag 15 by the opposing resilient edges 45 and a side wall 43 of each of the bag retention apertures 51. Such embodiments structured such that one or both of the areas 41 can be individually openable are advantageous in that either or both of the resultant apertures 51 can be opened in order to better control the preparation of a beverage within the container 11. For example, the multiple individually openable patterned areas 41 allow the exchange of gases from the interior of the container 11 with the exterior to be controlled. This thereby allows the change of the temperature of the liquid 19 and, accordingly, the beverage that is being prepared within the container 11 to be controlled.

FIG. 6C illustrates a partial cross sectional view of an embodiment of the present invention such as the one illustrated in FIGS. 6A and 6B that includes an openable patterned area 41. The patterned area 41 of the FIG. 6C embodiment comprises weakenings formed in or incisions cut through the flexible cover panel 22 such that a rounded bag retention aperture 51 with a door 87 having a hinge 57 to the lower portion 51A of the aperture 51 is formed. The patterned area 41 of this embodiment can be opened sufficiently to provide an aperture 51 by the application of pressure at the patterned area such as onto the inner retainer surface 28 of the side wall 26A at or adjacent to the openable patterned area 41. The opening of the patterned area 41, in part or entirely, exposes at least one resilient edge 45—that can facilitate the gripping of, for example, the upper side wall portion 16A of the bag side wall 16 and further facilitate the retention of the bag 15 at or above the liquid surface 19A within the supra-liquid space 14B. The door 87 can advantageously provide further support to the bag 15 in the elevated retained position 71 and may act to direct any liquid 19 that may drain from the bag 15 back into the container 11.

Figure 7A:
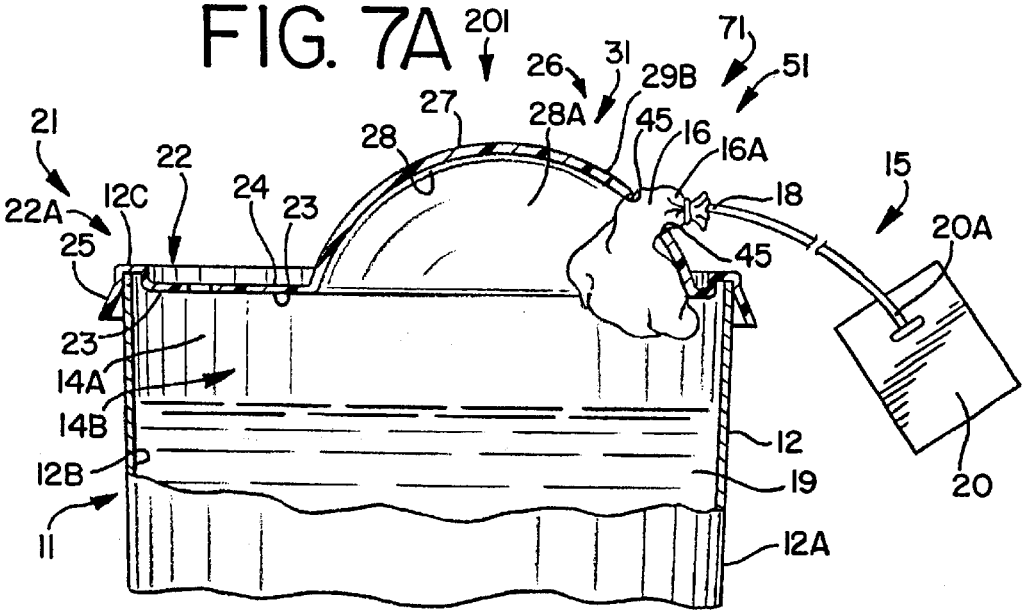
FIG. 7A illustrates a partial cross sectional view of an embodiment of the present invention showing a retainer including a full profile rounded open retention structure having a shaped bag retention aperture in which a beverage bag is retained in an elevated position.

FIG. 7A shows another embodiment of a retainer 21 including a rounded retention structure 31 having a full profile 201 through which a shaped open bag retention aperture 51 opens with a beverage bag 15 retained in an elevated position 71 thereby. The rounded raised retention structure 31 includes a continuous surrounding side wall 26A that rises in part adjacent to peripheral rim 25 and generally opposite to the drinking aperture 91 and defines a bag retention space 28A of sufficient size and shape to accommodate generally without squeezing confinement a bag or bags 15, each of which can be of many different sizes and shapes even after immersion within the container 11 and drawn upward and held in an elevated position 71. The embodiment includes one or more bag retention apertures 51 that open through the wall 26A on a side opposite to and spaced by the accommodation area 24A away from the aperture 91 such that one or more bags 15 may be retained in an elevated position 71 with little likelihood that the beverage consumer will encounter the bag or bags with his or her nose. The spacing of the apertures 51 on opposite sides 29A, 29B of the far side 29 of the wall 26A make this an even more remote possibility.

Figure 7B:
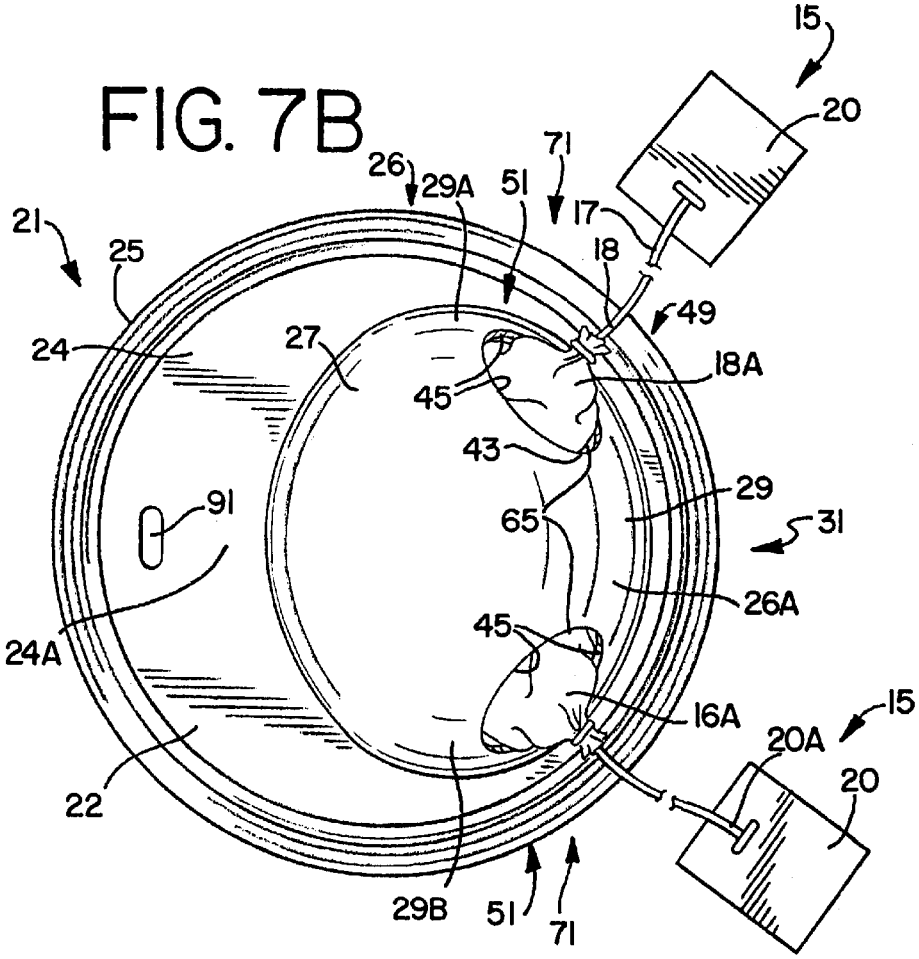
FIG. 7B illustrates an overhead view of an embodiment of the present invention such as one illustrated in FIG. 7A showing a retainer including a full profile rounded raised open retention structure having two open bag retention apertures through which two beverage bags in part have been drawn and retained in an elevated position by gripping of the side walls of each bag by the two bag retention apertures.

FIG. 7B shows an overhead view of an embodiment of a retainer 21 such as the one illustrated in FIG. 7A with a full profile 201 and two open bag retention apertures 51 through each of which a beverage bag 15 are drawn in part through and thereby retained in an elevated position 71 by the gripping of the side walls 16 of each bag by the opposing resilient edges 45 of the two retaining apertures 51. Again, the placement of the two apertures 51on either side of the central vertical axis of the container 11 as covered permits the container to remain generally balanced and not prone to tip over even with two swollen and therefore heavier bags retained in the elevated position 71. As with certain of the embodiments described herein, the rounded shape of the apertures 51 may lessen the likelihood that the bag may be ruptured when it is drawn into an elevated position 71. In particular, the oval shape of the apertures 51 may provide a gap 48 between the bag 15 and the opposing resilient edges 45 formed from the vertical side wall 43 of the aperture 51 that can act as a vent 65 even with the upper portion 16A of the bag 15 pulled through and within the aperture.

Figure 8A:
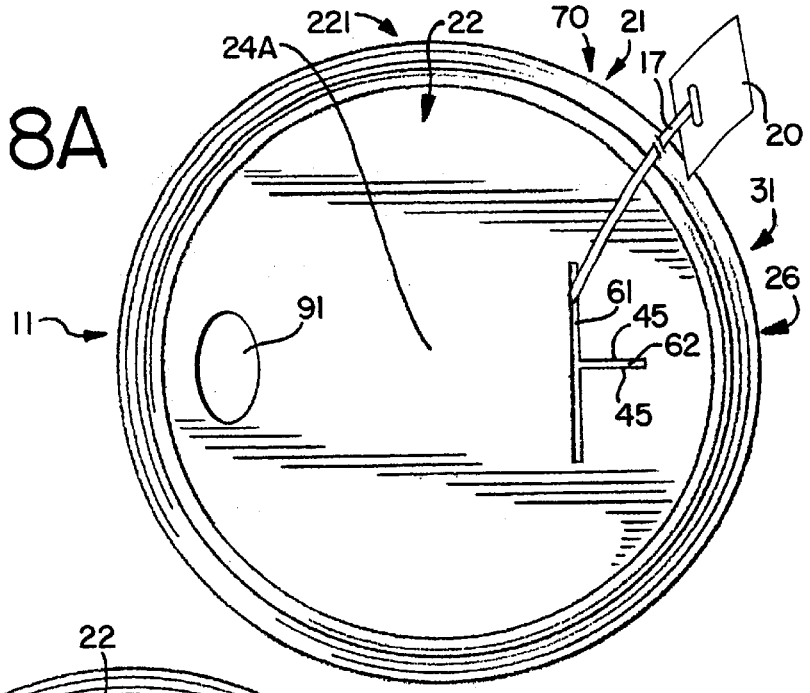
FIG. 8A illustrates an overhead view of an embodiment of the present invention showing a retainer including a retention structure having a generally even profile and an open string/tag aperture through which the tag, and the string by which the tag is attached to the bag may be passed such as without folding and a string engaging portion into which the string may be drawn and gripped thereby securing the bag to the retainer.

FIG. 8A shows an overhead view of another embodiment of a retainer 21 including a generally flat cover panel 22 and an even retention structure profile 221 through which a string/tag securing aperture 61 opens. The string/tag securing aperture 61 has a size and shape to facilitate the quick securement of the bag 15 to the retainer 21. The string/tag securing aperture 61 of the FIG. 8A embodiment is elongated in shape and sized such that the tag 20 and thereby the string 17 of the bag 15 can be threaded therethrough easily and quickly and generally without further opening of the aperture 61. The aperture 61 may be narrowed in size so that the portions of the string 17 and tag 20 that are above the liquid surface 19A do not easily fall into the liquid 19 such as while the bag is in the secured position 70 and the beverage is being prepared. A string/tag securing aperture 61 that is sized as shown to be wider than the width of a tag 20 is advantageous in that the securing aperture 61 even with tag 20 threaded therethrough can function also as a vent 65 such that gases from within the container 11 can be exchanged with those outside the container and vice versa. The string/tag securing aperture 61 of the FIGS. 8A through 8C embodiment includes a string engaging portion 62—having opposing resilient edges 45 that can grip and hold onto the string 17 as it is drawn into the portion 62 from the aperture 61 and thereby retain the bag 15 in an elevated position 71. While the string engaging portion 62 may be open or openable, the FIGS. 8A through 8C embodiment includes a portion 62 that is open.

Figure 8B:
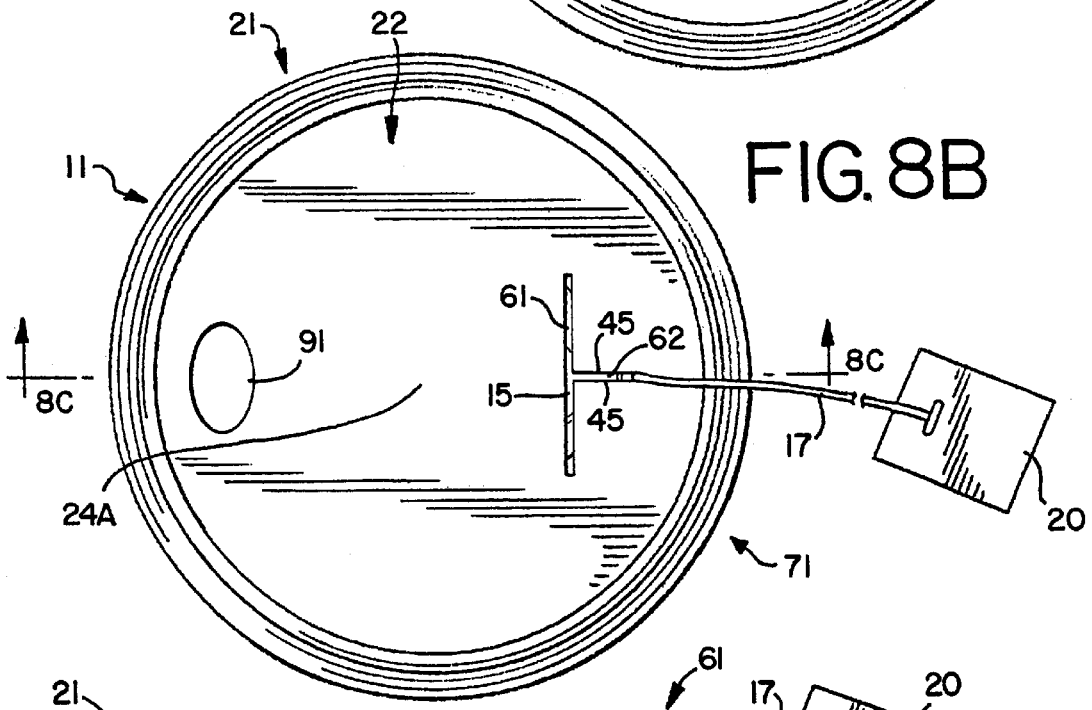
FIG. 8B illustrates an overhead view of the embodiment illustrated in FIG. 8A of the invention after the tag has been passed through the string/tag aperture and the string drawn through and gripped by the opposing resilient edges of the opened string engaging portion such that the beverage bag is secured to the retainer.

FIG. 8B illustrates an overhead view of the embodiment illustrated in FIG. 8A of the invention with the tag passed through the aperture 61 and the string 17 drawn through and gripped by the opposing resilient edges 45 of the open string engaging portion 62 such that the beverage bag 15 is secured to the retainer in an elevated position 71.

Figure 8C:
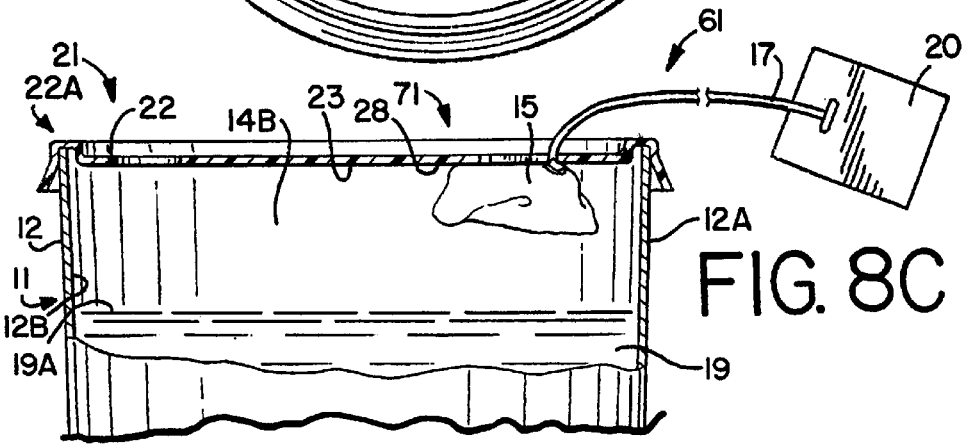
FIG. 8C illustrates a cross sectional view of the embodiment illustrated in FIGS. 8A and 8B and showing the string drawn through and gripped by the opposing resilient edges of the opened string engaging portion such that the beverage bag is retained in an elevated position and, in part, touching the lower surface of the retainer.

FIG. 8C illustrates a cross sectional view of the embodiment illustrated in FIGS. 8A and 8B and showing the string 17 drawn through and gripped by the opposing resilient edges 45 of the open string engaging portion 62 such that the beverage bag 15 is retained in an elevated position 71 within the supra-liquid space 14B and in part touching the retention surface 28 of the retainer 21. The embodiment Illustrated in FIGS. 8A through 8C includes an accommodation area that spaces the drinking aperture 91 from the retention structure 31.

Figures 9A, 9B, 9C:
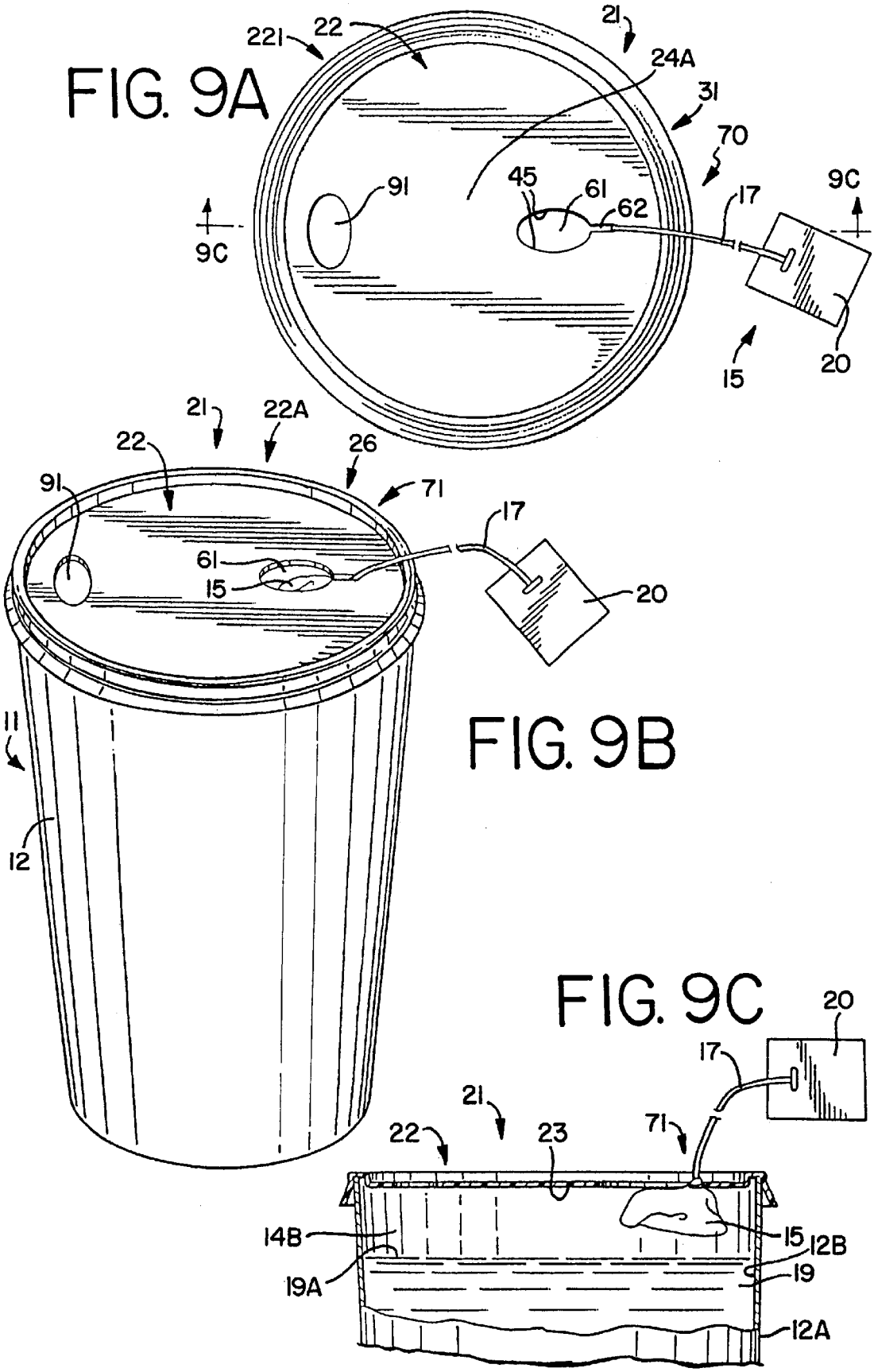
FIG. 9A illustrates an overhead view of an embodiment of the present invention showing a retainer including a retention structure having a generally even profile and an open shaped string/tag securing aperture through which the tag, and the bag string may be passed such as without folding and a string engaging portion into which the string may be drawn and secured thereby securing the bag to the retainer.
FIG. 9B illustrates a perspective view of the embodiment illustrated in FIG. 9A of the invention with the tag and in part the string passed through string/tag aperture and the string drawn through and gripped by the opposing resilient edges of the string engaging portion such that the beverage bag is secured to the retainer.
FIG. 9C illustrates a cross sectional view of the embodiment illustrated in FIGS. 9A and 9B and showing the string drawn through and gripped by the opposing edges of the string engaging portion such that the beverage bag is retained in an elevated position and, in part, touching the lower surface of the retainer.

FIG. 9A illustrates an overhead view of an embodiment of a retainer 21 including a retention structure 31 having a generally even profile 221 and an string/tag aperture 61 having an elongated rounded shape through which the tag 20, and the string 17 by which it is attached to the bag 15 may be passed such as without folding and retained in a secured position 70 and a narrowed component—a string engaging portion 62—having opposing resilient edges 45 that can grip and hold onto the string 17 as it is drawn into the portion 62 from the aperture 61 and thereby retain the bag 15 in an elevated position 71. FIG. 9B illustrates a perspective view of the embodiment illustrated in FIG. 9A of the invention with the tag passed through the aperture 61 and the string 17 drawn through and gripped by the opposing edges 45 of the string engaging portion such that the beverage bag 15 is secured to the retainer 21 in an elevated position 71. FIG. 9C illustrates a cross sectional view of the embodiment illustrated in FIGS. 9A and 9B and showing the string 17 drawn through and gripped by the opposing edges 45 of the string engaging portion 62 such that the beverage bag 15 is retained in an elevated position 71 within the supra-liquid space 14B and, in part, touching the lower surface 23 of the retainer 21.

FIG. 10A illustrates partially in phantom an embodiment of the retainer 21 including a cover panel 22 with retention structure with complete profile 241 having a generally flattened upper surface 24 and a side wall 26A generally perpendicular thereto through which two movable patterned areas 41 are individually openable such that at least the tag 20 and/or string 17 of one or two beverage bags 15 may be drawn in part through thereby retaining the bag or bags 15 such as in a secured position 70. Each patterned area 41 is formed of weakenings in or perforations or incisions cut through the surrounding side wall 26A of the flexible cover panel 22—that define an aperture cover 55. By the application of pressure at the patterned area 41—such as onto the inner retainer surfaces 28 at or adjacent to one or both openable patterned areas 41—, the aperture cover 55 of one or both is freed from the retainer 21—for subsequent disposal—and the aperture 51 of each exposed thereby. Each aperture 51 is sized and shaped to facilitate the threading of the string 17 and tag 20 of a bag 15 therethrough and the subsequent easy manipulation of the bag while in a secured position 70 and such that at least an upper portion 16A of a beverage bag 15 can drawn through and thereby retained in an elevated position 71 by the gripping of the side wall 16 of the bag 15 by the opposing resilient edges 45 of the bag retention apertures 51. Each aperture 51 of this embodiment includes a string engaging portion 62 into which the string 17 may be drawn and secured by the gripping of the string 17 by the opposing gripping edges 45 of the portion 62. Advantageously, an aperture of such a size and shape may act as a vent 65.

FIG. 10B shows the embodiment illustrated in FIG. 10A with areas 41 opened and two beverage bags 15 positioned such that the strings 17 of each are drawn through and thereby secured in an elevated position 71 by gripping of the string 17 by the opposing resilient edges 45 of each of the portion 62 of the bag retention apertures 51. As with the other embodiments that include multiple individually openable patterned areas 41, this embodiment permits greater individual control of the preparation of a beverage within the container.

FIGS. 11A through 11C illustrate an embodiment of a retainer 21 with alterable profile 231. FIG. 11A illustrates a perspective view of the retainer 21 including a cover panel 22 having a generally flattened upper surface 24 and a movable retention structure 31. FIG. 11A illustrates an embodiment of the movable raisable retention structure 31 in a non-raised position—such that the structure 31 has a generally even profile—with an open bag retention aperture 61 by which a beverage bag may be loosely secured to the retainer 31 and thereby to the container 11 by the threading of the tag 20 and string 17 through the retention aperture 61 of the retention structure 31. FIG. 11B illustrates a perspective view of the retainer 21 illustrated in FIG. 11A showing the raisable retention structure 31 in a raised position—such that the structure 31 has a reduced profile. FIG. 11C illustrates a cross-section of the retainer 21 illustrated in FIGS. 11A and 11B showing the raisable retention structure 31 in a raised position by the drawing of the bag 15 upward and against the lower surface 24 of the retention structure 31 such that the bag is retained in an elevated position 71 by the gripping of the side wall 16 of the bag by the opposing gripping edges 45 of the bag retention aperture 31.

FIGS. 12A through 12C show another embodiment of a retainer 21 including a retention structure 31 having a full retention structure profile 201 including a rounded raised area 26 through which a string/tag securing aperture 61 opens for the placement of the bag 15 in a generally secured position 70 relative to the retainer 21 and the liquid 19 within the container 11 for preparation of a beverage. When the preparation has been completed, the bag 15 may be drawn upward and releasably secured into a generally elevated position 71. The string/tag securing aperture 61 has a size and shape to facilitate the quick general securement of the bag 15 to the retainer 21 in a secured position 70. The string/tag securing aperture 61 of this embodiment is elongated in shape and sized such that the tag 20 and thereby the string 17 of the bag 15 can be threaded therethrough generally without further opening of the aperture 61 to permit the easy manipulation of the bag 15, such as upward and downward in the liquid 19 to further facilitate the preparation of a beverage. As shown in FIG. 12B, the bag may be pulled upward into an elevated position 71 such that a portion of the bag may be held by the gripping edges 45 of the aperture 51. The edges 45 are preferably rounded so that the bag can be pulled smoothly pass the edges 45 and to facilitate the gripping of the bag 15 without, for example, rupture. The curved shape of the aperture 51 facilitates even more effective gripping by the edges 45. Advantageously, the aperture 61 is placed offset from a position directly opposite to the drinking aperture 91 so that, for example, a consumer will not likely come into contact with a wet bag 15 exposed in an elevated position 71 yet the bag 15 remains in close enough proximity to the consumer's nose so that the fragrance from the wetted tea or other beverage preparation agent can be detected by the consumer while drinking thereby heightening the consumption experience. Also, while the bag is pulled through and gripped by the edges of the retainer such that the exposed area of the bag is off center and toward the surrounding edge of the retainer, the recess of the retainer is shaped such that the unexposed bag may collect in a location closer to the central axis of the cup. This allows the container with retainer in place and bag in a retained position to remain generally balanced and less likely to tip over.

Figure 13A:
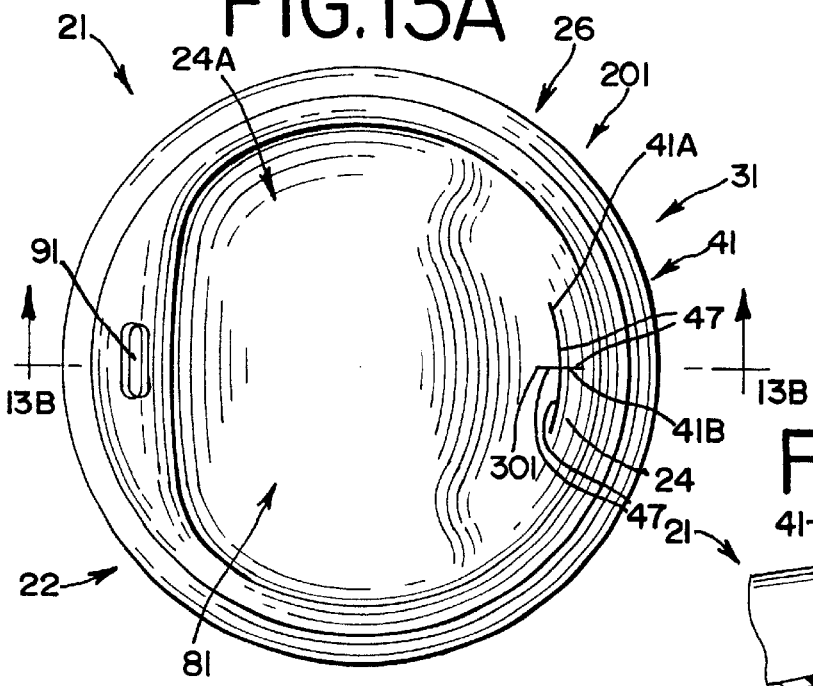
FIG. 13A illustrates an overhead view of an embodiment of the present invention showing a retainer including an openable retention structure having a rounded raised area with patterned area that may be opened partially or completely.
Figure 13C:
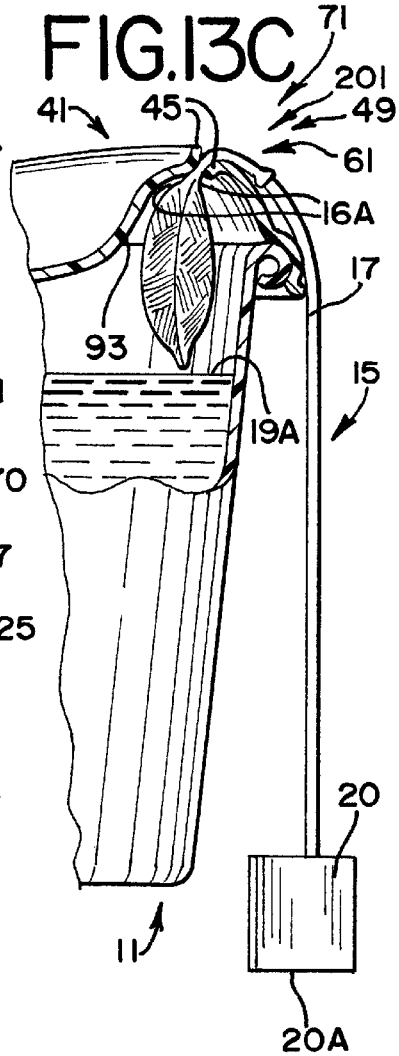
FIG. 13C illustrates a cross sectional partial view of the embodiment illustrated in FIGS. 13A and 13B showing the patterned area more completely opened such that the beverage bag is retained in an elevated position within the resultant bag retention aperture.
Figure 13B:
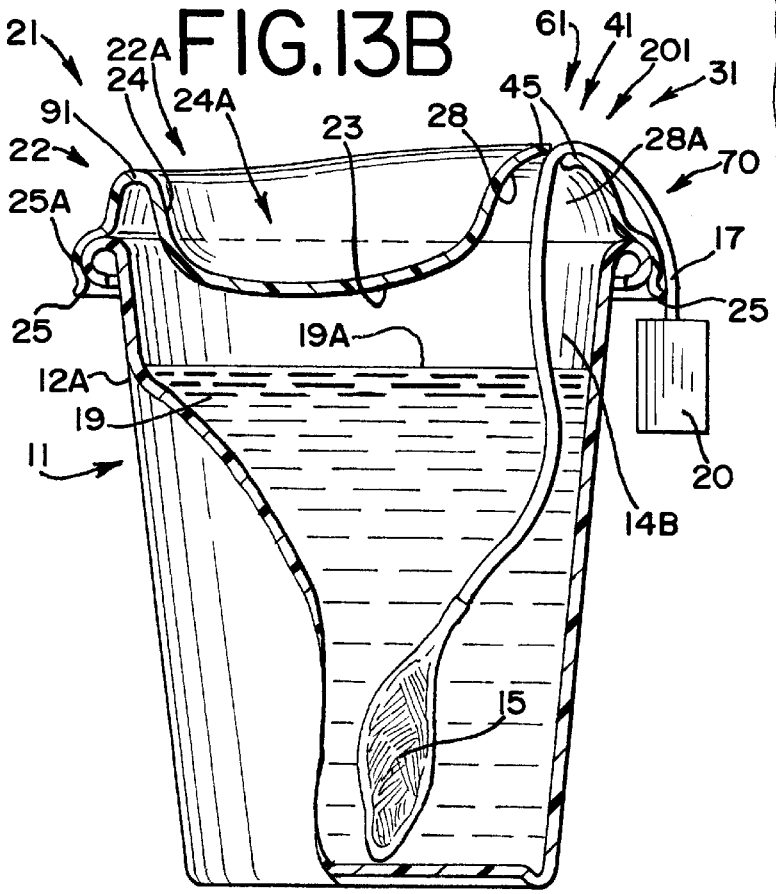
FIG. 13B illustrates a cross sectional view of the retainer illustrated in FIG. 13A showing the tag and the string, in part, passed through the partially opened patterned area such that the string is gripped by the opposing resilient edges of the resultant string/tag aperture such that the beverage bag is releasably secured to the retainer.

Embodiments of the present invention may include a rounded raised area 26 having a patterned area 41 in the flexible cover panel 22 that may be opened partially or completely to provide a string/tag securing aperture 61 or completely to provide a bag retention aperture 51 by the application of respectively increasing amounts of pressure at the patterned area 41. The patterned area 41 may be one or more patterns 41A of weakenings formed in or perforations or incisions cut through the flexible cover panel 22. The rounded raised area 26 of such embodiments may include a rounded generally continuous surrounding side wall 26A having an inner retainer surface 28 sized and shaped in proportion to the bag 15 used for immersion in order to provide a bag retention space 28A that may accommodate some or all of a bag 15 after immersion within the container 11 and after the bag has been drawn upward and held in an elevated position 71. FIGS. 13A through 13C illustrates one such embodiment of the invention.

The retainer 21 of the FIGS. 13A through 13C embodiment includes an openable retention structure 31 having a rounded generally continuous surrounding side wall 26A that rises, in part, adjacent to peripheral rim 25 and generally opposite to the drinking aperture 91 and includes an inner retainer surface 28. The surrounding side wall 26A, and thereby the inner retainer surface 28 is sized and shaped in proportion to the bag 15 such that the bag retention space 28A can accommodate some of the bag 15—if the bag is loosely placed in an elevated position 71 relative to the securing aperture 61—or nearly all or all of the bag—if the bag is pulled upward tightly against the inner retainer surface, and thereby possibly compressed to facilitate dehydration of the bag after immersion within the container 11. The patterned area 41 of the FIGS. 13A through 13C embodiment includes a linearly-aligned pattern 41A that crosses at a right angle to a generally shorter linearly-aligned pattern 41B. The illustrated patterned area 41 is placed at or near the apex 301 of the raised area and generally directly across from the drinking aperture 91. By the application of a relatively reduced amount of pressure at the patterned area 41, such as from below the retainer 21, one or both of the patterns 41A, 41B may be partially opened such that the tag 20 and/or string 17 may be easily passed therethrough and opposing resilient edges 45 are thereby exposed, in part or entirely, along one or both of the patterns 41A, 41B. Such exposed edges 45 can grip some or all of the bag inserted through the opened patterns 41A, 41B, such as, for example, the tag 20 or the string 17 and the bag 15 thereby can be placed at a variety of secured positions 70 relative to the retainer and the liquid 19 within the container 11 for preparation of a beverage. To further facilitate the quick passage of portions of the bag 15 through the opened patterned area 41, the patterns 41A, 41B of the illustrated embodiment may be dimensioned to accommodate one or more dimensions of the bag 15 without folding, compression, or extensive distortion—such as by an individual trying to prepare a beverage quickly and efficiently. The illustrated embodiment includes a pattern 41A that is generally equal or larger in size than that portion of the bag 15—such as the illustrated edge 20A of the tag 20—that typically would be threaded through the patterned area 41 first in order to secure the bag 15 to the retainer 21. By application of greater pressure at the openable patterned area 41—such as by drawing the bag upward against the inner retention surface 28 below the patterned area 41 after the steeping process has been completed by pulling upward on the string and/or tag exposed above the upper surface 24 of the retainer 21, the bag 15 is compressed against the retention surface 28—causing the bag to be at least partially dehydrated—and the patterned area 41 to be opened even more. The bag 15 can then be drawn in between the opposing resilient edges 45 such that the bag upper side wall portion 16A of the bag 15 is gripped and the bag 15 is retained in an elevated position 71 relative to the liquid surface 19A. Advantageously, the patterned area 41 of the embodiment illustrated in FIGS. 13A through 13C when opened exposes opposing tips 47 that can catch a portion of the upper portion 16A or other portion of the bag 15. The opposing tips 47 as exposed can thereby form a one-way catch 49 that may retain the bag 15 in an elevated position 71 at or above the surface 19A of the beverage 19.

The FIGS. 13A through 13C embodiment of the retainer 21 includes a nose/face accommodation area 24A that spaces the drinking aperture 91 from the rounded raised area 26 and, in part, the patterned area 41 and permits a consumer to drink from the aperture 91 with generally less likelihood that the consumer will encounter a portion of a bag inserted through, and thereby secured by or elevated relative to the patterned area 41. The illustrated nose/face accommodation area 24A includes a generally depressed area 81 that provides additional space to further accommodate portions of the consumer's face such as when the consumer has rotated the container 11 on which the retainer 21 is seated such as in order to drink from the aperture 91. The depressed area 81 as sized and shaped and placed in a central position within the retainer 21 as shown in FIGS. 13B and 13C advantageously forms a generally downwardly-sloping wall 93 whose lower surface 23 can further confine and restrict the movement of a bag such as to prevent it from blocking, for example, the drinking aperture 91. This feature is particularly useful when the bag 15 has been placed in a secured position 70 such that the bag 15 can swing freely—such as when the consumer rotates the container 11 to take a drink—and may thereby block the drinking aperture 91. This feature is useful also when the bag 15 is relatively large relative to the retainer 21 and, as a result, may still impede the flow of liquid from the drinking aperture 91 even when the bag 15 is drawn more closely to the inner retainer surface 23 in a secured position 70. The adjoining position of the nose/face accommodation area 24A relative to the patterned area 41 may have aromatherapeutic value particularly if the contents of the beverage bag after immersion and retained within the patterned area 41 has, for example, a particularly pleasant fragrance. This may heighten the consumption experience.

The following will further describe the use of certain embodiments of the retainer 21. In those embodiments having an openable retention structure 31, a person, such as one in the food service industry or the ultimate consumer, may apply pressure to the patterned area 41 to open the area 41 to provide at least a string/tag securing aperture 61 such that string 17 and, if the bag 15 has one, the tag 20 may be threaded through the aperture 61. This places the bag in a secured position 70 relative to the retainer with a portion of the string and tag above the upper surface 24 of the retainer 21 and the remaining portion of the string 17 and the bag 15 below the lower cover surface 23. In those embodiments having an open retention structure 31, the string 17 and tag 20 is threaded through the securing aperture 61 or retaining aperture 51 to place the bag in a secured position 70. The person then places the retainer 21 with bag 15 releasably secured thereto onto the lip 12C of the container 11 already holding the liquid 19 from which the beverage will be prepared such that the surrounding edge 25A of the retainer 21 is seated on the lip 12C of the container 11 and/or sealingly grips to the outer surface 12A of the side wall 12 of the container 11 and the bag 15 comes to be fully immersed in the liquid 19. At any time after the initial immersion of the bag 15 within the liquid 19, and, for example, after the retainer 21 seated on the container 11 is served, the consumer may advantageously sample the liquid in order to determine if the beverage preparation has been completed without removing the bag 15 from the liquid or the retainer from its position on the container. When the consumer has determined that the beverage is of the desired strength and/or flavor, the person can easily move the bag 15 from the beverage and to an elevated position 71 at or above the level 19A of the beverage 19 by pulling upward on the tag 20 and/or string 17 such that at least an upper portion 16A of the bag 16 is gripped between the opposing edges 45 of the retaining aperture 51 and thereby held in place. Liquid from the bag in this elevated position 71 advantageously drips back into the container 11. The beverage consumer can then drink through the aperture 91 of the retainer 21 even with the bag in this elevated position 71. The person does not need to come into direct contact with the wet bag 15 at any time in order to prepare a beverage with this apparatus and method. When the consumer is finished, the container 11 with retainer 21 and bag 15 retained in place can be disposed simultaneously thereby avoiding the need for the disposal of each of these items and additional cleanup. If the retainer 21 includes a second retention area 26, and the person wishes to use a second bag, for example, to flavor the beverage, the relevant portions of the process described above can be repeated. Because of the fragrance produced, for example, by many teas when wetted, one or more bags filled with such content and retained in an elevated position 71, and thereby exposed to the atmosphere can provide fragrance to at least the immediate area around the retainer 21. This fragrance can further heighten the beverage consumption experience and may constitute a form of aromatherapy for the beverage consumer.

It will be understood that the embodiments of the present invention which have been described are illustrative of some of the applications of the principles of the present invention. Numerous modifications may be made by those skilled in the art without departing from the true spirit and scope of the invention.

We claim:

1. A retainer for the controlled preparation of a beverage from liquid within a container and a bag containing a beverage preparation agent by movement of a string attached to the bag relative to said retainer seated on the container, the bag having a surrounding bag wall in which the beverage preparation agent is enclosed, the container including a surrounding container wall having an inner surface and outer surface that meet to form a lip, the lip defining a mouth of the container, the container wall being suitable to hold the liquid with which the beverage may be prepared by immersion of the beverage bag within the liquid, the string having a bag end attached to the beverage bag and a free end, said retainer comprising:

a flexible cover panel including an upper surface and an opposing lower surface, said upper surface sized and shaped such that said panel generally extends over the container mouth, said upper surface and lower surface meet at a peripheral rim and form a surrounding edge wall sized and shaped such that said retainer can be seated on and form a releasingly sealing grip about the lip;

a drinking aperture opening through said flexible cover panel to provide access to the liquid within the container;

a rounded raised area including a generally continuous surrounding side wall and a patterned area, said generally continuous side wall having an inner retainer surface that defines a bag retention space, said patterned area including one or more patterns of weakenings formed in or perforations or incisions cut through said flexible cover panel that are openable outward and above said rounded raised area or open by application of pressure at or around said patterned area, said patterns as opened include resilient edges and at least a securing aperture sized and shaped such that at least a portion of the bag may be inserted therethrough and secured to said retainer by gripping of some or all of the inserted portion of the bag by said resilient edges; and a nose/face accommodation area separating said drinking aperture from said rounded raised area, said nose/face accommodation area sized and shaped to accommodate portions of a face of a consumer and placed such that it is less likely that the consumer will encounter the inserted portion of the bag secured by or elevated relative to said patterned area when the consumer is drinking from said drinking aperture.

2. The retainer according to claim 1, wherein said patterns cross at right angles and are placed at an apex of said rounded raised area.

3. The retainer according to claim 1, wherein said nose/face accommodation area includes a depressed area centrally placed within said retainer and forming a downwardly-sloping wall sized and shaped such that said lower surface restricts movement of the bag as secured relative to said retainer and as at least partially gripped by said gripping resilient edges.

4. A retainer for a container having a surrounding container wall suitable to hold a liquid with which a beverage may be prepared by immersion of a beverage bag within the liquid, said surrounding container wall including an inner surface and outer surface that meet to form a lip defining a mouth of the container, the beverage bag having a bag side wall enclosing beverage preparation contents and to which a string is attached, the string having a bag end at which the string is attached to the beverage bag and an opposing free end, said retainer comprising:

a flexible cover panel extending over the container mouth and including a peripheral rim and a surrounding edge wall sized and shaped such that said retainer can releasably grip the container;

a drinking aperture through which the liquid may be drawn directly or indirectly by a consumer;

a rounded generally continuous surrounding side wall rising generally adjacent to said peripheral rim and opposite to and spaced from said drinking aperture;

a patterned area openable through and outward from said rounded generally continuous surrounding side wall, said patterned area including patterns of weakenings formed in or perforations or incisions cut through said flexible cover panel that are partially openable outward by application of pressure at or around said patterned area to provide opposing resilient edges defining a string/tag securing aperture by which the string or a tag attached thereto can be gripped and the bag placed at a variety of secured positions relative to said retainer and the liquid within the container for preparation of the beverage;

said patterns more completely openable outward to provide a bag retention aperture by which said opposing resilient edges may grip and retain the bag in an elevated position relative to an upper surface of the liquid;

said rounded generally continuous surrounding side wall including an inner retainer surface sized and shaped in proportion to the bag to provide a bag retention space such that the bag may be immersed within the liquid and after immersion withdrawn at least within said bag retention space to facilitate dehydration of the bag; and a generally depressed area sized and shaped and placed in a central position within said retainer to accommodate nose or face portions of a consumer such that it is less likely that the nose or face portions of the consumer will encounter the bag in said secured or elevated positions relative to said patterned area when the consumer is drawing the beverage from said drinking aperture.

5. The retainer according to claim 4, wherein said patterned area is positioned at or near an apex of said rounded generally continuous surrounding side wall.

6. The retainer according to claim 4, wherein said generally depressed area is sized and shaped and positioned to form a generally downwardly-sloping wall by which the bag in said secured positions may be prevented from blocking said drinking aperture when said retainer as seated on the container is rotated.

7. The retainer according to claim 4, wherein one or more of said patterns of said patterned area are dimensioned to accommodate at least the tag of the bag without prefolding of the tag such that the tag may be quickly inserted through said string/tag securing aperture.

8. The retainer according to claim 4, wherein said opposing resilient edges of said patterns include opposing tips that can form a generally one-way catch by which the bag may be retained in said elevated position relative to the upper surface of the liquid.

9. A retainer for a container having a surrounding container wall suitable to hold a liquid with which a beverage may be prepared by immersion of a beverage bag within the liquid, said surrounding container wall including an inner surface and outer surface that meet to form a lip defining a mouth of the container, the beverage bag having a bag side wall enclosing beverage preparation contents and to which a string is attached, the string having a bag end at which the string is attached to the beverage bag and an opposing free end, said retainer comprising:

a generally flexible cover panel covering the mouth of the container;

a drinking aperture through which the beverage may be consumed;

an openable retention structure including a rounded generally continuous surrounding side wall having an inner retainer surface sized and shaped in proportion to the bag to provide a bag retention space such that the bag may be secured to the container during immersion of the bag within the liquid for preparation of the beverage and after the preparation of the beverage drawn to an elevated position relative to the beverage within the container to prevent further immersion and to facilitate dehydration of the bag;

a patterned area openable outward from said rounded generally continuous surrounding side wall;

said patterned area including patterns of weakenings formed in or perforations or incisions cut through said flexible cover panel that are openable outward by application of pressure at or around said patterned area to secure the bag to said retainer in a variety of secured positions relative to said retainer and the liquid within the container during preparation and consumption of the beverage by a consumer; and a depressed area separating said drinking aperture from said openable retention structure, said depressed area sized and shaped to accommodate facial portions of the consumer such that it is less likely that the facial portions of the consumer will encounter the bag when the consumer is consuming the beverage from said drinking aperture and the bag is in said elevated position.

10. The retainer according to claim 9, wherein said patterned area is positioned at or near an apex of said rounded generally continuous surrounding side wall.

11. The retainer according to claim 9, wherein said depressed area includes a generally downwardly-sloping wall having a depressed area lower surface sized and shaped to confine and restrict movement of the bag in said secured positions.

12. The retainer according to claim 9, wherein said patterns are sized and shaped to be partially openable outward to provide opposing resilient edges defining a string/tag securing aperture by which the string or a tag attached thereto can be gripped and the bag placed at said secured positions relative to said retainer and the liquid within the container for preparation of the beverage.

13. The retainer according to claim 9, wherein said patterns are sized and shaped to be completely openable outward to provide opposing resilient edges defining a bag retention aperture by which the bag may be gripped and retained in said elevated position relative to an upper surface of the liquid.

14. The retainer according to claim 9, wherein one or more of said patterns of said patterned area are dimensioned to accommodate at least a tag attached to the opposing free end of the string without prefolding of the tag such that the tag may be quickly inserted through said patterned area when opened.

15. The retainer according to claim 9, wherein said opposing resilient edges of said patterns include opposing tips that can form a generally one-way catch by which the bag may be retained in said elevated position relative to an upper surface of the liquid.

* * * * *